US010640980B2

(12) United States Patent
Haddock

(10) Patent No.: US 10,640,980 B2
(45) Date of Patent: May 5, 2020

(54) METAL PANEL ELECTRICAL BONDING CLIP

(71) Applicant: RMH Tech LLC, Colorado Springs, CO (US)

(72) Inventor: Dustin M. M. Haddock, Colorado Springs, CO (US)

(73) Assignee: RMH Tech LLC, Colorado Springs, CO (US)

( * ) Notice: Subject to any disclaimer, the term of this patent is extended or adjusted under 35 U.S.C. 154(b) by 0 days.

(21) Appl. No.: 15/798,023

(22) Filed: Oct. 30, 2017

(65) Prior Publication Data

US 2018/0119423 A1 May 3, 2018

Related U.S. Application Data

(60) Provisional application No. 62/415,355, filed on Oct. 31, 2016.

(51) Int. Cl.
*E04D 3/362* (2006.01)
*E04D 13/00* (2006.01)
(Continued)

(52) U.S. Cl.
CPC ..... *E04D 3/362* (2013.01); *E04D 3/363* (2013.01); *E04D 13/00* (2013.01); *H01R 4/58* (2013.01);
(Continued)

(58) Field of Classification Search
CPC ..... E04D 3/362; E04D 13/00; H01R 4/48; H01R 4/58
(Continued)

(56) References Cited

U.S. PATENT DOCUMENTS 42,992 A 5/1864 Howe
97,316 A 11/1869 Rogers
(Continued)

FOREIGN PATENT DOCUMENTS

AT 13076 8/1903
AT 26329 11/1906
(Continued)

OTHER PUBLICATIONS

"ADJ Heavy Duty Lighting C-clamp," Sweetwater, 2011, 3 pages [retrieved online from: http://web.archive.org/web/20111112045516/http://www.sweetwater.com/store/detail/CClamp/].
(Continued)

*Primary Examiner* — Patrick J Maestri
*Assistant Examiner* — Joseph J. Sadlon
(74) *Attorney, Agent, or Firm* — Sheridan Ross P.C.

(57) ABSTRACT

A clip for electrically bonding a pair of adjacently-disposed metal panels is disclosed. One embodiment entails such a clip (104) including a first clip member (112) and an oppositely disposed second clip member (116). The surface (114) of the first clip member (112) that faces the second clip member (116) includes at least one grounding projection (128), while the surface (118) of the second clip member (116) that faces the first clip member (112) also includes at least one grounding projection (128). The clip (104) may be installed on a standing seam (102) of a panel assembly (100), with its first clip member (112) engaging one of the metal panels 82" that define this stand seam (102) and with its second clip member (116) engaging the other of the metal panels 82" that define this same standing seam (102).

21 Claims, 14 Drawing Sheets

(51) Int. Cl.

| | |
|---|---|
| ***H01R 4/58*** | (2006.01) |
| ***E04D 3/363*** | (2006.01) |
| *H01R 4/48* | (2006.01) |
| *H01R 4/64* | (2006.01) |
| *E04D 3/366* | (2006.01) |

(52) U.S. Cl.
CPC ..... *E04D 3/366* (2013.01); *H01R 4/48* (2013.01); *H01R 4/64* (2013.01)

(58) Field of Classification Search
USPC ..... 52/98, 520, 521
See application file for complete search history.

(56) References Cited

U.S. PATENT DOCUMENTS 106,580 A 8/1870 Hathorn
189,431 A 4/1877 Creighton
250,580 A 12/1881 Rogers
332,413 A * 12/1885 List ..... E04D 3/366 52/466
386,316 A 7/1888 Hawthorne
405,605 A * 6/1889 Sagendorph ..... E04D 3/362 52/520
407,772 A * 7/1889 Curtis et al. ..... E04D 3/362 52/520
446,217 A * 2/1891 Dickelman ..... E04D 3/362 52/520
459,876 A 9/1891 Powers
472,014 A 3/1892 Densmore
473,512 A 4/1892 Laird
491,173 A 2/1893 Hayward
507,776 A 10/1893 Berger et al.
529,774 A 11/1894 Baird
602,983 A 4/1898 Folsom
733,697 A * 7/1903 Chronik ..... H01R 4/64 439/524
756,884 A 4/1904 Parry
831,445 A * 9/1906 Kosmatka ..... B42F 1/06 24/563
881,757 A * 3/1908 Winsor ..... A45F 5/022 24/10 A
884,850 A 4/1908 Peter
927,522 A 7/1909 Gery
933,784 A 9/1909 Peter
939,516 A 11/1909 Laird
1,054,091 A 2/1913 Darnall
1,085,474 A 1/1914 Peterson
1,136,460 A 4/1915 Wright
1,230,363 A 6/1917 Baird
1,330,309 A 2/1920 Dixon
1,399,461 A 12/1921 Childs
1,463,065 A 7/1923 Sieger
1,465,042 A 8/1923 Hruska
1,511,529 A 10/1924 Standlee
1,620,428 A * 3/1927 Becker ..... H01R 4/64 191/29 R
1,735,927 A 11/1929 Shaffer
1,735,937 A 11/1929 Shaffer
1,893,481 A 1/1933 Adams
1,946,862 A * 2/1934 Koch, Jr. ..... H01R 4/26 439/791
1,957,933 A * 5/1934 Brandl ..... E04B 1/617 52/467
2,079,768 A 5/1937 Levow
2,150,497 A 3/1939 Fernberg
2,183,844 A 12/1939 Murphy
2,192,720 A 3/1940 Tapman
2,201,320 A 5/1940 Place
2,250,401 A 7/1941 Sylvester
2,274,010 A 2/1942 Stellin
2,340,692 A 2/1944 Ridd
2,429,833 A 10/1947 Luce
2,443,362 A 6/1948 Tinnerman
2,448,752 A 9/1948 Wagner
2,457,250 A 12/1948 Macomber
2,472,586 A 6/1949 Harvey
2,504,776 A 4/1950 Woodfield et al.
2,525,217 A 10/1950 Glitsch
2,574,007 A 11/1951 Anderson
2,658,247 A 11/1953 Heuer
2,714,037 A 7/1955 Singer et al.
2,730,381 A 1/1956 Curtiss
2,740,027 A 3/1956 Budd et al.
2,808,491 A * 10/1957 Rhee ..... H01H 1/26 200/257
2,810,173 A * 10/1957 Bearden ..... E04D 13/076 108/33
2,875,805 A 3/1959 Flora
3,039,161 A 6/1962 Gagnon
3,064,772 A 11/1962 Clay
3,095,672 A 7/1963 Di Tullio
3,112,016 A 11/1963 Peterson
3,136,206 A 6/1964 Adams
3,194,524 A 7/1965 Trumbull
3,221,467 A 12/1965 Henkels
3,231,076 A * 1/1966 Freiman ..... B65D 55/00 206/585
3,232,573 A 2/1966 Berman
3,242,620 A 3/1966 Kaiser
3,288,409 A 11/1966 Bethea, Jr.
3,296,750 A 1/1967 Zaleski
3,298,653 A 1/1967 Omholt
3,301,513 A 1/1967 Masao
3,307,235 A 3/1967 Hennings
3,318,057 A 5/1967 Norsworthy
3,333,799 A 8/1967 Peterson
3,335,995 A 8/1967 Pickles
3,363,864 A 1/1968 Olgreen
3,394,524 A 7/1968 Howarth
3,425,127 A 2/1969 Long
3,482,369 A 12/1969 Burke
3,495,363 A 2/1970 Johnson
3,496,691 A 2/1970 Seaburg et al.
3,503,244 A 3/1970 Joslin
3,523,709 A 8/1970 Heggy et al.
3,527,619 A 9/1970 Miley
3,565,380 A 2/1971 Langren
3,572,623 A 3/1971 Lapp
3,590,543 A 7/1971 Heirich
3,656,747 A 4/1972 Revell, Jr. et al.
3,667,182 A 6/1972 Stemler
3,667,185 A 6/1972 Maurer
3,719,919 A 3/1973 Tibolla
3,753,326 A 8/1973 Kaufman, Sr.
3,778,537 A 12/1973 Miller
3,792,560 A 2/1974 Naylor
3,809,799 A 5/1974 Taylor
3,817,270 A 6/1974 Ehrens et al.
3,824,664 A 7/1974 Seeff
3,845,601 A 11/1974 Kostecky
3,861,098 A 1/1975 Schaub
3,904,161 A 9/1975 Scott
3,914,001 A 10/1975 Nelson et al.
3,921,253 A * 11/1975 Nelson ..... E05D 1/02 16/257
3,960,352 A 6/1976 Plattner et al.
3,986,746 A 10/1976 Chartier
4,001,474 A 1/1977 Hereth
4,007,574 A 2/1977 Riddell
4,018,538 A 4/1977 Smyrni et al.
4,051,289 A 9/1977 Adamson
4,127,975 A * 12/1978 Judkins ..... E04B 2/7409 52/489.2
4,130,970 A 12/1978 Cable
4,141,182 A 2/1979 McMullen
4,162,595 A 7/1979 Ramos et al.
4,162,755 A 7/1979 Bott
4,189,882 A 2/1980 Harrison et al.
4,189,891 A 2/1980 Johnson et al.
4,200,107 A 4/1980 Reid
4,203,646 A * 5/1980 Desso ..... H01R 4/4809 136/244

(56) References Cited

U.S. PATENT DOCUMENTS 4,215,677 A 8/1980 Erickson
4,223,053 A 9/1980 Brogan
4,252,458 A 2/1981 Keen
4,261,338 A 4/1981 McAlister
4,261,384 A 4/1981 Dahlbring
4,270,721 A 6/1981 Mainor, Jr.
4,307,976 A * 12/1981 Butler ..... E04D 13/076 24/338
4,321,416 A 3/1982 Tennant
4,351,140 A 9/1982 Simpson
4,366,656 A 1/1983 Simpson
4,393,859 A 7/1983 Marossy et al.
4,449,335 A * 5/1984 Fahey ..... E04B 1/2608 52/713
4,456,321 A * 6/1984 Jones ..... H01R 4/2445 439/395
4,461,514 A * 7/1984 Schwarz ..... B60B 7/10 24/293
4,467,582 A 8/1984 Hague
4,475,776 A 10/1984 Teramachi
4,546,586 A 10/1985 Knudson
4,567,706 A * 2/1986 Wendt ..... E04F 13/0823 52/361
4,570,405 A 2/1986 Knudson
4,593,877 A 6/1986 van der Wyk
4,601,600 A 7/1986 Karlsson
4,656,794 A 4/1987 Thevenin et al.
4,666,116 A 5/1987 Lloyd
4,674,252 A 6/1987 Nicholas et al.
4,682,454 A 7/1987 Simpson
4,686,809 A 8/1987 Skelton
4,701,586 A 10/1987 Hagberg
4,704,058 A 11/1987 Crunwell
4,773,791 A 9/1988 Hartkorn
4,782,642 A * 11/1988 Conville ..... E04F 13/081 52/770
4,799,444 A 1/1989 Lisowski
4,805,364 A 2/1989 Smolik
4,809,476 A 3/1989 Satchell
4,810,573 A 3/1989 Harriett
4,835,927 A 6/1989 Michlovic
4,840,529 A 6/1989 Phillips
4,848,858 A 7/1989 Suzuki
4,854,096 A 8/1989 Smolik
4,878,331 A 11/1989 Taylor
4,895,338 A 1/1990 Froutzis
4,905,444 A 3/1990 Semaan
4,909,011 A 3/1990 Freeman et al.
4,949,929 A 8/1990 Kesselman et al.
4,961,712 A * 10/1990 Schwenk ..... F16B 7/0413 439/436
4,970,833 A 11/1990 Porter
4,987,699 A 1/1991 Gold
4,991,368 A 2/1991 Amstutz
5,007,612 A 4/1991 Manfre
5,019,111 A 5/1991 Dempsey et al.
5,036,949 A 8/1991 Crocker et al.
5,039,352 A * 8/1991 Mueller ..... E04C 2/525 136/246
5,092,939 A 3/1992 Nath et al.
5,094,435 A 3/1992 Depperman
5,118,571 A 6/1992 Petersen
5,119,612 A 6/1992 Taylor et al.
5,125,608 A 6/1992 McMaster et al.
5,127,205 A * 7/1992 Eidson ..... E04D 3/3608 52/478
5,138,820 A 8/1992 Pearce
5,140,793 A 8/1992 Knudson
5,152,107 A 10/1992 Strickert
5,164,020 A 11/1992 Wagner et al.
5,176,462 A 1/1993 Chen
5,187,911 A 2/1993 Cotter
5,213,300 A 5/1993 Rees
5,222,340 A 6/1993 Bellem
5,224,427 A 7/1993 Riches et al.
5,228,248 A 7/1993 Haddock
5,251,993 A 10/1993 Sigourney
5,268,038 A 12/1993 Riermeier et al.
5,271,194 A 12/1993 Drew
5,277,006 A 1/1994 Ruster
5,282,340 A 2/1994 Cline et al.
5,287,670 A 2/1994 Funaki
5,307,601 A 5/1994 McCracken
5,312,079 A 5/1994 Little, Jr.
5,313,752 A 5/1994 Hatzinikolas
D347,701 S 6/1994 McCracken
5,352,154 A * 10/1994 Rotter ..... E04D 1/36 454/365
5,356,519 A 10/1994 Grabscheid et al.
5,356,705 A 10/1994 Kelch et al.
D351,989 S 11/1994 Cline et al.
5,363,624 A 11/1994 Cotter
5,379,567 A 1/1995 Vahey
5,390,453 A 2/1995 Untiedt
5,392,574 A 2/1995 Sayers
5,408,797 A 4/1995 Bellem
5,409,549 A 4/1995 Mori
5,413,063 A 5/1995 King
5,413,397 A 5/1995 Gold
5,417,028 A 5/1995 Meyer
5,425,209 A 6/1995 Funaki
5,426,906 A 6/1995 McCracken
5,439,307 A 8/1995 Steinhilber
5,453,027 A 9/1995 Buell et al.
D364,338 S 11/1995 Cline
5,479,752 A 1/1996 Menegoli
5,482,234 A 1/1996 Lyon
5,483,772 A 1/1996 Haddock
5,483,782 A 1/1996 Hall
5,491,931 A 2/1996 Haddock
5,497,591 A 3/1996 Nelson
5,522,185 A 6/1996 Cline
5,533,839 A 7/1996 Shimada
D372,421 S 8/1996 Cline
5,557,903 A 9/1996 Haddock
5,571,338 A 11/1996 Kadonome et al.
5,596,858 A 1/1997 Jordan
5,596,859 A 1/1997 Horton et al.
5,598,785 A 2/1997 Zaguroli, Jr.
D378,343 S 3/1997 Macor
5,609,326 A 3/1997 Stearns et al.
5,613,328 A 3/1997 Alley
5,640,812 A 6/1997 Crowley et al.
5,647,178 A 7/1997 Cline
5,660,008 A 8/1997 Bevilacqua
5,664,750 A 9/1997 Cohen
5,681,191 A * 10/1997 Robicheau ..... H01R 4/184 439/877
5,688,131 A * 11/1997 Byfield, Jr. ..... H01R 4/64 439/883
D387,443 S 12/1997 Blankenbiller
5,694,721 A 12/1997 Haddock
5,697,197 A 12/1997 Simpson
5,715,640 A 2/1998 Haddock
5,732,513 A 3/1998 Alley
5,743,063 A 4/1998 Boozer
5,743,497 A 4/1998 Michael
5,746,029 A 5/1998 Ullman
5,755,824 A 5/1998 Blechschmidt et al.
5,765,310 A 6/1998 Gold
5,765,329 A 6/1998 Huang
5,787,653 A 8/1998 Sakai et al.
5,794,386 A 8/1998 Klein
5,809,703 A 9/1998 Kelly
5,826,379 A 10/1998 Curry
5,826,390 A 10/1998 Sacks
5,828,008 A 10/1998 Lockwood et al.
5,829,723 A 11/1998 Brunner et al.
5,842,318 A 12/1998 Bass et al.
5,890,340 A 4/1999 Kafarowski
5,901,507 A 5/1999 Smeja et al.
5,941,931 A 8/1999 Ricks
5,942,046 A 8/1999 Kahlfuss et al.

(56) References Cited

U.S. PATENT DOCUMENTS 5,970,586 A 10/1999 Demel et al.
5,983,588 A 11/1999 Haddock
5,994,640 A 11/1999 Bansemir et al.
6,029,415 A 2/2000 Culpepper et al.
6,073,410 A 6/2000 Schimpf et al.
6,073,920 A 6/2000 Colley
6,079,678 A 6/2000 Schott et al.
6,088,979 A 7/2000 Neal
6,095,462 A 8/2000 Morgan
6,099,203 A 8/2000 Landes
6,105,317 A 8/2000 Tomiuchi et al.
6,106,310 A * 8/2000 Davis ..... H01R 4/26 439/92
6,111,189 A 8/2000 Garvison et al.
6,119,317 A 9/2000 Pfister
6,132,070 A 10/2000 Vosika et al.
6,158,180 A 12/2000 Edwards
6,164,033 A 12/2000 Haddock
6,182,403 B1 2/2001 Mimura et al.
6,206,991 B1 3/2001 Starr
6,223,477 B1 5/2001 Alley
6,237,297 B1 5/2001 Paroly
6,253,496 B1 7/2001 Gilchrist
6,256,934 B1 7/2001 Alley
6,269,596 B1 8/2001 Ohtsuka et al.
6,276,285 B1 8/2001 Ruch
6,336,616 B1 1/2002 Lin
6,360,491 B1 3/2002 Ullman
6,364,262 B1 4/2002 Gibson et al.
6,364,374 B1 4/2002 Noone et al.
6,370,828 B1 4/2002 Genschorek
6,382,569 B1 5/2002 Schattner et al.
6,385,914 B2 5/2002 Alley
6,393,796 B1 5/2002 Goettl et al.
6,443,680 B1 9/2002 Bodin
6,453,623 B1 9/2002 Nelson et al.
6,470,629 B1 10/2002 Haddock
6,497,080 B1 12/2002 Malcolm
6,499,259 B1 12/2002 Hockman
6,508,442 B1 1/2003 Dolez
6,521,821 B2 2/2003 Makita et al.
6,534,702 B1 * 3/2003 Makita ..... H01L 31/048 136/244
6,536,729 B1 3/2003 Haddock
6,576,830 B2 6/2003 Nagao et al.
6,602,016 B2 8/2003 Eckart et al.
6,622,441 B2 9/2003 Miller
6,637,671 B2 10/2003 Alley
6,655,633 B1 12/2003 Chapman, Jr.
6,665,991 B2 12/2003 Hasan
6,688,047 B1 2/2004 McNichol
D487,595 S 3/2004 Sherman
6,715,256 B1 4/2004 Fischer
6,718,718 B2 4/2004 Haddock
6,725,623 B1 4/2004 Riddell et al.
6,730,841 B2 5/2004 Heckeroth
6,732,982 B1 5/2004 Messinger
6,751,919 B2 6/2004 Calixto
D495,595 S 9/2004 Dressler
D496,738 S 9/2004 Sherman
6,799,742 B2 10/2004 Nakamura et al.
6,834,466 B2 12/2004 Trevorrow et al.
6,918,217 B2 7/2005 Jakob-Bamberg et al.
6,918,727 B2 7/2005 Huang
6,922,948 B2 8/2005 Smeja et al.
6,967,278 B2 11/2005 Hatsukaiwa et al.
7,012,188 B2 3/2006 Erling
7,013,612 B2 3/2006 Haddock
7,063,763 B2 6/2006 Chapman, Jr.
7,100,338 B2 9/2006 Haddock
7,104,020 B1 9/2006 Suttle
7,127,852 B1 10/2006 Dressler
7,191,794 B2 3/2007 Hodges
7,195,513 B1 3/2007 Gherardini
7,219,863 B1 5/2007 Collett, II
7,240,770 B2 7/2007 Mullins et al.
7,260,918 B2 8/2007 Liebendorfer
7,281,695 B2 10/2007 Jordan
7,386,922 B1 6/2008 Taylor et al.
7,406,924 B1 8/2008 Impey
7,410,139 B1 8/2008 Rorich
7,431,252 B2 10/2008 Birli et al.
7,435,134 B2 10/2008 Lenox
7,451,573 B2 11/2008 Orszulak et al.
7,458,555 B2 12/2008 Mastropaolo et al.
7,459,196 B2 * 12/2008 Sturm ..... B60R 13/0846 24/535
7,469,511 B2 12/2008 Wobber
7,493,730 B2 2/2009 Fennell, Jr.
7,513,080 B1 4/2009 Showalter
7,516,580 B2 4/2009 Fennell, Jr.
7,568,871 B2 * 8/2009 Chopp, Jr. ..... F16B 5/0275 411/389
7,578,711 B2 8/2009 Robinson
7,600,349 B2 10/2009 Liebendorfer
7,658,356 B1 2/2010 Nehls
7,686,625 B1 * 3/2010 Dyer ..... H01R 4/64 439/857
7,703,256 B2 4/2010 Haddock
7,707,800 B2 5/2010 Kannisto
7,721,492 B2 * 5/2010 Plaisted ..... H02S 20/23 52/173.3
7,731,138 B2 6/2010 Wiesner et al.
7,758,011 B2 7/2010 Haddock
7,766,292 B2 8/2010 Liebendorfer
7,780,472 B2 8/2010 Lenox
7,788,874 B2 9/2010 Miller
7,788,879 B2 9/2010 Brandes et al.
7,824,191 B1 11/2010 Browder
7,827,920 B2 11/2010 Beck et al.
7,845,127 B2 12/2010 Brescia
7,847,181 B2 12/2010 Brescia
7,861,480 B2 1/2011 Wendelburg et al.
7,874,117 B1 1/2011 Simpson
7,891,618 B2 2/2011 Carnevali
7,915,519 B2 3/2011 Kobayashi
7,926,777 B2 4/2011 Koesema, Jr.
7,954,287 B2 6/2011 Bravo et al.
8,011,153 B2 9/2011 Orchard
8,066,200 B2 11/2011 Hepner et al.
8,092,129 B2 1/2012 Wiley et al.
8,096,503 B2 1/2012 Verweyen
8,109,048 B2 2/2012 West
8,146,299 B2 4/2012 Stearns et al.
8,151,522 B2 4/2012 Stearns et al.
8,153,700 B2 4/2012 Stearns et al.
D658,977 S 5/2012 Riddell et al.
8,226,061 B2 7/2012 Nehls
8,272,172 B2 9/2012 Li
8,294,026 B2 10/2012 Wang et al.
8,312,678 B1 11/2012 Haddock
8,316,590 B2 11/2012 Cusson
8,316,621 B2 11/2012 Safari Kermanshahi et al.
8,344,239 B2 1/2013 Plaisted
8,347,572 B2 1/2013 Piedmont
8,375,654 B1 2/2013 West et al.
8,387,319 B1 3/2013 Gilles-Gagnon et al.
8,404,963 B2 * 3/2013 Kobayashi ..... F24S 25/615 136/244
8,407,895 B2 4/2013 Hartelius et al.
8,413,946 B2 * 4/2013 Hartelius ..... F24S 25/12 248/500
8,430,372 B2 4/2013 Haddock
8,448,405 B2 5/2013 Schaefer et al.
8,453,986 B2 6/2013 Schnitzer
8,458,967 B2 * 6/2013 Kalkanoglu ..... E04F 13/0864 136/244
8,495,997 B1 * 7/2013 Laubach ..... F24S 25/13 126/680
8,505,254 B2 8/2013 Welter et al.
8,528,888 B2 9/2013 Header
8,584,424 B2 11/2013 Smith
8,627,617 B2 1/2014 Haddock et al.

(56) References Cited

U.S. PATENT DOCUMENTS

D699,176 S 2/2014 Salomon et al.
8,640,402 B1 2/2014 Bilge
8,656,649 B2 2/2014 Haddock
8,683,751 B2 4/2014 Stearns
8,701,354 B2 4/2014 Stearns et al.
8,752,338 B2 6/2014 Schaefer et al.
8,756,870 B2 6/2014 Teller et al.
8,770,885 B2 7/2014 Myers
8,776,456 B1 7/2014 Schrock
8,782,983 B2 7/2014 Stearns
8,791,611 B2 * 7/2014 Arnould ..... H01R 4/28 310/71
8,813,441 B2 8/2014 Rizzo
8,826,618 B2 9/2014 Stearns
8,829,330 B2 9/2014 Meyer et al.
8,833,714 B2 9/2014 Haddock et al.
8,839,573 B2 9/2014 Cusson et al.
8,844,234 B2 * 9/2014 Haddock ..... E04F 13/0821 52/545
8,850,754 B2 10/2014 Rizzo
8,854,829 B1 10/2014 Bopp et al.
8,888,431 B2 * 11/2014 Haney ..... H01R 43/027 411/539
8,893,441 B1 * 11/2014 Hess, III ..... E04B 1/26 52/167.1
8,894,424 B2 11/2014 DuPont
D718,703 S 12/2014 Rizzo
D718,704 S 12/2014 Rizzo
8,910,928 B2 12/2014 Header
8,925,263 B2 1/2015 Haddock et al.
8,966,833 B2 3/2015 Ally
9,003,728 B2 * 4/2015 Asci ..... H02S 20/26 52/173.3
9,011,034 B2 4/2015 Liu
9,065,191 B2 6/2015 Martin et al.
9,085,900 B2 7/2015 Haddock
9,086,185 B2 7/2015 Haddock
9,127,451 B1 9/2015 Boor
9,134,044 B2 9/2015 Stearns et al.
9,147,785 B2 9/2015 Haddock et al.
D740,113 S * 10/2015 Olenick ..... E04D 3/366 D8/399
9,200,456 B2 * 12/2015 Murphy ..... E04F 13/0801
9,222,263 B2 12/2015 Haddock
9,306,490 B2 4/2016 Haddock et al.
9,341,285 B2 * 5/2016 Magno, Jr. ..... H02G 3/32
9,447,988 B2 9/2016 Stearns et al.
9,530,916 B2 12/2016 Haddock et al.
9,534,390 B2 1/2017 Pendley et al.
9,608,559 B2 3/2017 Haddock et al.
9,611,652 B2 4/2017 Haddock et al.
9,647,433 B2 5/2017 Meine
9,714,670 B2 7/2017 Header
9,722,532 B2 8/2017 Almy
9,732,512 B2 8/2017 Haddock
9,850,661 B2 12/2017 Kovacs
9,920,958 B2 3/2018 Haddock et al.
9,926,706 B2 * 3/2018 Hockman ..... E04D 13/10
10,036,414 B2 * 7/2018 Wiley ..... F16B 7/187
10,053,856 B2 8/2018 Haddock
10,054,336 B2 8/2018 Haddock et al.
10,077,562 B2 9/2018 Haddock et al.
10,103,682 B2 10/2018 Haddock et al.
10,106,987 B2 10/2018 Haddock et al.
10,385,573 B2 8/2019 Van Leuven
10,454,190 B1 * 10/2019 Martin ..... H01R 4/64
1,055,109 A1 2/2020 De Vogel et al.
2002/0026765 A1 3/2002 Vahey
2002/0088196 A1 7/2002 Haddock
2003/0015637 A1 1/2003 Liebendorfer
2003/0062078 A1 4/2003 Mimura
2003/0070368 A1 4/2003 Shingleton
2003/0131551 A1 7/2003 Mollinger et al.
2003/0146346 A1 8/2003 Chapman, Jr.
2003/0173460 A1 9/2003 Chapman, Jr.
2003/0201009 A1 10/2003 Nakajima et al.
2004/0035065 A1 2/2004 Orszulak et al.
2004/0055233 A1 3/2004 Showalter
2004/0164208 A1 8/2004 Nielson et al.
2004/0231949 A1 11/2004 Le et al.
2004/0237465 A1 12/2004 Refond
2005/0102958 A1 5/2005 Anderson
2005/0115176 A1 6/2005 Russell
2005/0210769 A1 9/2005 Harvey
2005/0257434 A1 11/2005 Hockman
2006/0065805 A1 3/2006 Barton et al.
2006/0075691 A1 4/2006 Verkamlp
2006/0096061 A1 5/2006 Weiland et al.
2006/0174571 A1 8/2006 Panasik et al.
2006/0174931 A1 8/2006 Mapes et al.
2006/0254192 A1 11/2006 Fennell, Jr.
2007/0131273 A1 6/2007 Kobayashi
2007/0199590 A1 8/2007 Tanaka et al.
2007/0241238 A1 10/2007 Neace
2007/0246039 A1 10/2007 Brazier et al.
2007/0248434 A1 10/2007 Wiley et al.
2007/0289229 A1 12/2007 Aldo
2007/0289233 A1 * 12/2007 Haddock ..... E04C 2/08 52/309.4
2008/0035140 A1 2/2008 Placer et al.
2008/0041011 A1 2/2008 Kannisto
2008/0190047 A1 8/2008 Allen
2008/0236520 A1 10/2008 Maehara et al.
2008/0265232 A1 10/2008 Terrels et al.
2008/0302407 A1 12/2008 Kobayashi
2009/0000220 A1 1/2009 Lenox
2009/0007520 A1 1/2009 Navon
2009/0194098 A1 8/2009 Placer
2009/0229213 A1 * 9/2009 Mistelski ..... A01M 31/02 52/650.3
2009/0230205 A1 9/2009 Hepner et al.
2009/0320826 A1 12/2009 Kufner
2010/0058701 A1 3/2010 Yao et al.
2010/0133040 A1 6/2010 London
2010/0154784 A1 6/2010 King et al.
2010/0162641 A1 7/2010 Reyal et al.
2010/0171016 A1 7/2010 Haddock
2010/0175738 A1 7/2010 Huss et al.
2010/0193651 A1 8/2010 Railsback et al.
2010/0206303 A1 8/2010 Thorne
2010/0212720 A1 8/2010 Meyer et al.
2010/0276558 A1 11/2010 Faust et al.
2010/0288337 A1 11/2010 Rizzo
2010/0293874 A1 11/2010 Liebendorfer
2010/0314517 A1 12/2010 Patzer
2011/0078892 A1 4/2011 Hartelius et al.
2011/0120047 A1 5/2011 Stearns et al.
2011/0154750 A1 6/2011 Welter et al.
2011/0174360 A1 7/2011 Plaisted et al.
2011/0209745 A1 9/2011 Korman
2011/0214365 A1 9/2011 Aftanas
2011/0214388 A1 9/2011 London
2011/0239546 A1 10/2011 Tsuzuki et al.
2011/0260027 A1 10/2011 Farnham, Jr.
2011/0271611 A1 11/2011 Maracci et al.
2011/0272545 A1 11/2011 Liu
2011/0314752 A1 12/2011 Meier
2012/0073630 A1 3/2012 Wu
2012/0079781 A1 4/2012 Koller
2012/0085041 A1 4/2012 Place
2012/0102853 A1 5/2012 Rizzo
2012/0153108 A1 6/2012 Schneider
2012/0167364 A1 7/2012 Koch et al.
2012/0192519 A1 8/2012 Ray
2012/0193310 A1 8/2012 Fluhrer et al.
2012/0201601 A1 8/2012 Rizzo
2012/0244729 A1 9/2012 Rivera et al.
2012/0248271 A1 10/2012 Zeilenga
2012/0298188 A1 11/2012 West et al.
2012/0299233 A1 11/2012 Header
2012/0325761 A1 12/2012 Kubsch et al.
2013/0048056 A1 2/2013 Kilgore et al.
2013/0168525 A1 7/2013 Haddock

(56) References Cited

U.S. PATENT DOCUMENTS

| | | | |
|---|---|---|---|
| 2013/0220403 | A1 | 8/2013 | Rizzo |
| 2013/0227833 | A1 | 9/2013 | Rizzo |
| 2013/0263917 | A1 | 10/2013 | Hamamura |
| 2013/0313043 | A1 | 11/2013 | Lallier |
| 2013/0340358 | A1 | 12/2013 | Danning |
| 2014/0003861 | A1 | 1/2014 | Cheung |
| 2014/0041202 | A1 | 2/2014 | Schnitzer et al. |
| 2014/0069048 | A1 | 3/2014 | Ally |
| 2014/0096462 | A1 | 4/2014 | Haddock |
| 2014/0179133 | A1 | 6/2014 | Redel |
| 2014/0220834 | A1 | 8/2014 | Rizzo |
| 2014/0283467 | A1 | 9/2014 | Chabas et al. |
| 2015/0060620 | A1 | 3/2015 | Smeja |
| 2015/0107168 | A1 | 4/2015 | Kobayashi |
| 2015/0200620 | A1 | 7/2015 | Haddock et al. |
| 2015/0214884 | A1 | 7/2015 | Rizzo |
| 2016/0025262 | A1 | 1/2016 | Stearns et al. |
| 2016/0060869 | A1 | 3/2016 | Smeja |
| 2016/0111835 | A1 | 4/2016 | Nayar |
| 2016/0111997 | A1 | 4/2016 | Ganshaw et al. |
| 2016/0111998 | A1 | 4/2016 | Schmid |
| 2016/0160524 | A1 | 6/2016 | Malins |
| 2017/0067258 | A1 | 3/2017 | Stearns et al. |
| 2018/0013382 | A1 | 1/2018 | Smeja |
| 2018/0031279 | A1 | 2/2018 | Haddock et al. |
| 2018/0128295 | A1 | 5/2018 | Haddock |
| 2019/0106885 | A1 | 4/2019 | Stearns et al. |
| 2019/0226214 | A1 | 7/2019 | Van Leuven |
| 2019/0273460 | A1 | 9/2019 | Kovacs |
| 2019/0330853 | A1 | 10/2019 | Van Leuven |

FOREIGN PATENT DOCUMENTS

| | | |
|---|---|---|
| AT | 298762 | 5/1972 |
| AU | 2005201707 | 11/2006 |
| AU | 2009101276 | 1/2010 |
| AU | 2009245849 | 6/2010 |
| CH | 204783 | 5/1939 |
| CH | 388590 | 2/1965 |
| CH | 469159 | 2/1969 |
| CH | 671063 | 7/1989 |
| CN | 202025767 | 11/2011 |
| DE | 298762 | 4/1916 |
| DE | 941690 | 4/1956 |
| DE | 2126082 | 12/1972 |
| DE | 2523087 | 11/1976 |
| DE | 2556095 | 6/1977 |
| DE | 3326223 | 4/1984 |
| DE | 3617225 | 11/1987 |
| DE | 3723020 | 1/1989 |
| DE | 3728831 | 1/1989 |
| DE | 9112788 | 12/1991 |
| DE | 4115240 | 10/1992 |
| DE | 10056177 | 5/2002 |
| DE | 10062697 | 7/2002 |
| DE | 10344202 | 4/2004 |
| DE | 202005006951 | 8/2005 |
| DE | 102005002828 | 8/2006 |
| DE | 202006015336 | 12/2006 |
| DE | 202007002252 | 4/2007 |
| DE | 202007018367 | 7/2008 |
| DE | 102007036206 | 2/2009 |
| DE | 202009010984 | 12/2009 |
| DE | 102008032985 | 1/2010 |
| EP | 0481905 | 4/1992 |
| EP | 0952272 | 10/1999 |
| EP | 1126098 | 8/2001 |
| EP | 1447494 | 8/2004 |
| EP | 1804008 | 7/2007 |
| EP | 2105971 | 9/2009 |
| EP | 2327942 | 6/2011 |
| EP | 2375185 | 10/2011 |
| EP | 3364124 | 10/2019 |
| EP | 3361183 | 12/2019 |
| FR | 469159 | 7/1914 |
| FR | 1215468 | 4/1960 |
| FR | 2468209 | 4/1981 |
| FR | 2515236 | 4/1983 |
| FR | 2638772 | 5/1990 |
| FR | 2793827 | 11/2000 |
| FR | 2997169 | 4/2014 |
| GB | 2364077 | 1/2002 |
| GB | 2430946 | 4/2007 |
| GB | 2465484 | 5/2010 |
| GB | 2476104 | 6/2011 |
| JP | S56-158486 | 12/1981 |
| JP | H03-166452 | 7/1991 |
| JP | H04-73367 | 3/1992 |
| JP | H04-366294 | 12/1992 |
| JP | H05-346055 | 12/1993 |
| JP | H09-256562 | 9/1997 |
| JP | 2000-179106 | 6/2000 |
| JP | 2000-234423 | 8/2000 |
| JP | 2000-303638 | 10/2000 |
| JP | 2001-303724 | 10/2001 |
| JP | 2002-146978 | 5/2002 |
| JP | 2003-096986 | 4/2003 |
| JP | 2003-155803 | 5/2003 |
| JP | 2004-060358 | 2/2004 |
| JP | 2004-068270 | 3/2004 |
| JP | 2004-092134 | 3/2004 |
| JP | 2004-124583 | 4/2004 |
| JP | 2004-156326 | 6/2004 |
| JP | 2004-264009 | 9/2004 |
| JP | 2004-278145 | 10/2004 |
| JP | 2005-171623 | 6/2005 |
| JP | 2006-097291 | 4/2006 |
| JP | 2011-069130 | 4/2011 |
| JP | 2011-236611 | 11/2011 |
| KR | 100957530 | 5/2010 |
| NL | 2021378 | 1/2020 |
| NL | 2021379 | 1/2020 |
| NL | 2021380 | 1/2020 |
| PT | 3066398 | 12/2019 |
| PT | 3066399 | 12/2019 |
| WO | WO 96/30606 | 10/1996 |
| WO | WO 97/08399 | 3/1997 |
| WO | WO 99/55982 | 11/1999 |
| WO | WO 03/098126 | 11/2003 |
| WO | WO 2008/021714 | 2/2008 |
| WO | WO 2010/140878 | 12/2010 |
| WO | WO 2011/019460 | 2/2011 |
| WO | WO 2012/014203 | 2/2012 |
| WO | WO 2012/017711 | 2/2012 |
| WO | WO 2012/048056 | 4/2012 |
| WO | WO 2013/009375 | 1/2013 |
| WO | WO 2018/169391 | 9/2018 |

OTHER PUBLICATIONS

"Aluminum," Wikipedia, Jul. 3, 2016, 21 pages [retrieved Oct. 3, 2017 from: en.wikipedia.org/w1ki/Aluminium].

"ClampFit-H Product Sheet," Schletter GmbH, Kirchdorf, Germany, Nov. 2015, 2 pages.

"Oil Canning—Solutions," Pac-Clad, 2001, 2 pages [retrieved online from: pac-clad.com/aiapresentation/sld021.htm].

"Oil Canning," Metal Construction Association, 2003, Technical Bulletin #95-1060, 2 pages.

"Snowbar(TM)—The Ultimate in Snow Retention for Standing Seam Roofs," Riddell & Company, Inc., 2011, 7 pages [retrieved online from: snobar.com].

Gallo "Oil-Canning," Metal Roofing Alliance, Ask-the-experts forum, Jun. 7, 2005, 4 pages [retrieved online from: www.metalroofingalliance.net/v2/forums/printview.cfm?action=mboard.members/viewmessages&ForumTopicID=4921&ForumCategoryID=1] (Originally Cited as Miller).

Haddock "History and Materials," Metalmag, Metal roofing from A (Aluminum) to Z (Zinc)—Part I, Sep./Oct. 2001, 4 pages.

Haddock "Metallic Coatings for Carbon Steel," Metalmag, Metal roofing from a (Aluminum) to Z (Zinc)—Part II, Nov./Dec. 2001, 8 pages.

(56) References Cited

OTHER PUBLICATIONS

International Search Report and Written Opinion for International (PCT) Patent Application No. PCT/US17/59065, dated Jan. 29, 2018 11 pages.
"Kee Walk—Roof Top Walkway," Simplified Safety, 2011, 3 pages [retrieved online from: https://web.archive.org/web/20120207115154/http://simplifiedsafety.com/solutions/keewalk-rooftop-walkway/].
"Miller Fusion Roof Anchor Post," Miller Fall Protection, 2011, 3 pages [retrieved online from: https://web.archive.org/web/20111211154954/www.millerfallprotection.com/fall-protection-products/roofing-products/miller-fusion-roof-anchor-post].
"KeeLine® The Safety Solution for Horizontal Life Lines," Kee Safety, Ltd. 2012, 2 pages [retrieved online from: https://web.archive.org/web/20120305120830/http://keesafety.co.uk/products/kee_line].
"New 'Alzone 360 system'", Arrid, 2008, 34 pages [retrieved online from: https://web.archive.org/web/20120317120735/www.arrid.com.au/?act=racking_parts].
"REES—Snow Retention Systems," Weerbewind, 2010, 3 pages [retrieved online from: https://web.archive.org/web/20100310075027/www.rees-oberstdorf.de/en/products/snow-retention-system.html].
"Solar mount. System," Schletter GmbH, 2012, 1 page [retrieved online from: https://web.archive.org/web/20120316154604/www.schletter.de/152-1-Solar-mounting-systems.html].
Ideematec Tracking & Mounting Systems [online], Apr. 2008, [retrieved Mar. 6, 2012], Retrieved from http://www.ideematec.de.
International Preliminary Report on Patentability for International (PCT) Patent Application No. PCT/US17/59065, dated May 9, 2019 7 pages.

* cited by examiner

METAL PANEL ELECTRICAL BONDING CLIP

CROSS-REFERENCE TO RELATED APPLICATIONS

This patent application claims the benefit of U.S. Provisional Patent Application Ser. No. 62/415,355, entitled "METAL PANEL ELECTRICAL BONDING CLIP," filed on Oct. 31, 2016, and the entire disclosure of which is hereby incorporated by reference.

FIELD

The present invention generally relates to metal panel assemblies for building surfaces and, more particularly, to electrically grounding such panel assemblies.

BACKGROUND

Metal panels are being increasingly used to define building surfaces such as roofs and sidewalls. One type of metal panel is a standing seam panel, where portions of adjacent standing seam panels of the building surface are interconnected/nested in a manner that defines a standing seam. Standing seam panels are expensive compared to other metal panels, and building surfaces defined by metal panels may be more costly than other types of building surface constructions.

It is often desirable to install various types of structures on building surfaces, such as heating, air conditioning, and ventilation equipment. Installing structures on standing seam panel building surfaces in a manner that punctures the building surface at one or more locations is undesirable in a number of respects. One is simply the desire to avoid puncturing what is a relatively expensive building surface. Another is that increasing the number of locations where a metal panel building surface is punctured may increase the potential for leakage and/or corrosion.

Electrical equipment of various types may be installed on a panel assembly defined by a plurality of interconnected metal panels. It is possible that the panel assembly could be energized by such electrical equipment.

SUMMARY

The present invention is embodied by a clip that may be installed on a metal panel assembly to electrically connect a pair of adjacent metal panels of this panel assembly. Hereafter such a clip may be referred to herein as an electrical bonding clip (to electrically "bond" two metal panels together—to electrically interconnect or provide an electrical path between these two adjacent metal panels). Generally, the electrical bonding clip is configured to simultaneously engage each metal panel of a pair of adjacent metal panels. In one embodiment the electrical bonding clip is installed in a first orientation on the panel assembly (e.g., a vertical orientation (e.g., orthogonal to a pitch of the overall panel assembly); where a closed end of the electrical bonding clip is at least generally vertically disposed/oriented relative to the overall panel assembly; where the electrical bonding clip is installed on interconnected portions of adjacent panels from the panel assembly, such as on a standing seam). Another embodiment has the electrical bonding clip being installed in a second orientation on the panel assembly, where this second orientation is different from the noted first orientation (e.g., a horizontal orientation (e.g., parallel to a pitch of the overall panel assembly); where a closed end of the electrical bonding clip is at least generally horizontally disposed/oriented relative to the overall panel assembly; where one portion of the electrical bonding clip engages the upper and lower surface of only one metal panel, where another portion of this same electrical bonding clip engages only the upper and lower surfaces of an adjacent metal panel, and where an intermediate portion of the electrical bonding clip extends between these two panel-engaging portions and is disposed on only one side (e.g., an underside) of the panel assembly). The present invention encompasses such an electrical bonding clip, alone/individually or as incorporated by a panel assembly that includes a plurality of interconnected metal panels.

A first aspect of the present invention is directed to a panel assembly having a first metal panel, a second metal panel, and an electrical bonding clip. The first and second metal panels include first and second edge portions, respectively, with a standing seam being defined by the interconnection of the first and second edge portions. The electrical bonding clip engages at least part of the first metal panel and also engages at least part of the second metal panel to provide an electrical connection or path between the first and second metal panels.

A number of feature refinements and additional features are applicable to the first aspect of the present invention. These feature refinements and additional features may be used individually or in any combination. The following discussion is applicable to this first aspect. Unless otherwise noted herein and with regard to the electrical bonding clip being in its installed configuration for the panel assembly: 1) a horizontal or lateral dimension coincides with a width of the standing seam, where the lateral dimension will typically be oriented so as to be at a constant elevation proceeding across a sloped roofing surface that incorporates the panel assembly; 2) a longitudinal dimension is orthogonal to the lateral dimension and coincides with a length of the standing seam, including where the length dimension of the standing seam is significantly greater than the width dimension of the standing seam, and where the longitudinal dimension will typically coincide with/match a pitch of a sloped roofing surface that incorporates the panel assembly; and 3) a vertical or height dimension is orthogonal to a reference plane that contains each of the lateral dimension and the longitudinal dimension (e.g., orthogonal to a pitch of the overall panel assembly).

The standing seam defined by the interconnection of the first and second edge portions of the first and second metal panels, respectively, may be of any appropriate configuration. For instance, the standing seam may be in the form of a hollow seam rib of any appropriate configuration (e.g., having a pair of rib sidewalls that are separated from one another by an open space). The standing seam may also be of a single lock/fold configuration or a double lock/fold configuration.

The first metal panel and the second metal panel each may include a pair of edge portions (or side edge portions or longitudinal edge portions) that are oppositely disposed and spaced from one another (e.g., spaced in the noted lateral dimension). The first metal panel and the second metal panel each may include a pair of ends (or lateral edges) that are oppositely disposed and spaced from one another (e.g., spaced in the noted longitudinal dimension). Each edge portion for both the first metal panel and the second metal panel extends between the two ends of its corresponding panel. A standing seam that is collectively by interconnected edge portions of a pair of adjacently disposed panels of the panel assembly may be characterized as being disposed/oriented orthogonally to the two ends (or lateral edges) of each of these metal panels.

The electrical bonding clip may be mounted on the standing seam, for instance so as to simultaneously engage adjacently disposed/interfacing portions of the first and second metal panels that are part of the standing seam (e.g., the electrical bonding clip may engage overlapping portions of the first metal panel and the second metal panel that define at least part of the standing seam). The electrical bonding clip may also be configured and installed such that: 1) a first portion of the electrical bonding clip engages the upper and lower surface of only the first metal panel and on a first side of the standing seam in/relative to the lateral dimension; 2) a second portion of the electrical bonding clip engages the upper and lower surface of only the second metal panel and on a second side of the standing seam in/relative to the lateral dimension, where the first and second sides of the standing seam are opposite of one another; and 3) an intermediate portion of the electrical bonding clip extends between the noted first and second portions and is disposed on only one side (e.g., an underside) of the panel assembly, including where this intermediate portion is engaged with the panel assembly and/or where this intermediate portion is actually spaced from the panel assembly.

Any appropriate electrically-conductive material or combination of materials (e.g., stainless steel; a conductive metal or metal alloy) may be used to form the electrical bonding clip. One embodiment has the electrical bonding clip being of an integral construction such that there is not a joint of any kind between any adjacent portions of the electrical bonding clip. One embodiment has the entirety of the electrical bonding clip being formed of an electrically-conductive metal or electrically-conductive metal alloy.

The electrical bonding clip may be characterized as including at least one clip section, such as a first clip section. Each clip section (and including the first clip section) for the electrical bonding clip may include a first clip member and a second clip member that are disposed in opposing relation to one another, with a living hinge interconnecting the first clip member and the second clip member. This living hinge may define a "closed-end" for the first clip section, including where the first clip section includes an "open-end" that is opposite of this closed-end, and where the "open-end" is defined at least in part by the first clip member (e.g., a free end thereof) and the second clip member (e.g., a free end thereof) being movable relatively away from one another (e.g., by a pivotal or pivotal-like motion about the living hinge). A length dimension of the living hinge (or stated another way the axis about which the first clip member may move relative to its corresponding second clip member) may coincide with the vertical dimension in the installed configuration for the electrical bonding clip, or may coincide with the lateral dimension in the installed configuration for the electrical bonding clip.

The first clip member may be biased toward the second clip member. Moving the first clip member away from and relative to the second clip member (e.g., the respective free ends thereof) may be opposed by at least one biasing force (e.g., by an elastic deflection of the above-noted living hinge). One embodiment (e.g., where the electrical bonding clip has a single clip section) has a first surface of the first clip member facing or projecting toward a second surface of the second clip member that faces the first clip member (e.g., the first surface of the first clip member and the second surface of the second clip member may face or project toward one another). The first surface of the first clip member may include at least one first grounding projection of any appropriate type/configuration. The second surface of the second clip member may include at least one second grounding projection of any appropriate type/configuration. Each first grounding projection incorporated by the first clip member, as well as each second grounding projection incorporated by the second clip member, may be configured to break a coating on the panel assembly, for instance when installing the electrical bonding clip on the panel assembly. In the case where the electrical bonding clip includes a single clip section, the electrical path may be from the first metal panel to the first clip member (including via one or more grounding projections of the first clip member that engages the first metal panel), from the first clip member to the second clip member via the noted living hinge (or more generally a closed end for the electrical bonding clip), and from the second clip member to the second metal panel (including via one or more grounding projections of the second clip member that engages the second metal panel).

One embodiment of the electrical bonding clip accommodates its installation directly on a standing seam of the panel assembly, for instance on overlapping portions of the first metal panel and the second metal panel that define at least part of the standing seam. The electrical bonding clip may engage a portion of the standing seam that is oriented in the vertical dimension in the installed configuration for the electrical bonding clip. A closed end of the electrical bonding clip may be disposed over a portion of one end of the first metal panel and over a portion of one end of the second metal panel that are adjacent to one another in the panel assembly. Such an electrical bonding clip may include a single clip section in accordance with the foregoing, for instance the above-noted first clip section, and including without limitation where at least one grounding projection of the first clip member engages part of the first metal panel that defines at least part of the standing seam and where at least one grounding projection of the second clip member engages part of the second metal panel that defines at least part of this same standing seam.

The electrical bonding clip may include a plurality of clip sections, for instance a first clip section and a second clip section. These first and second clip sections may be spaced from one another in the lateral dimension for the installed configuration of the electrical bonding clip. The electrical bonding clip may be configured such that the first clip section engages only the first metal panel and such that the second clip section engages only the second metal panel. The first clip section may be disposed on a first side of the standing seam (e.g., in/relative to the lateral dimension), and the second clip section may be disposed on a second side of this same standing seam (e.g., in/relative to the lateral dimension). As such, the first and second clip sections may be characterized as being disposed on opposite sides of the standing seam. The first clip section may be disposed adjacent to or may be spaced from the first side of the standing seam, while the second clip section may be disposed adjacent to or may be spaced from the second side of this same standing seam.

The first clip member for each of the first and second clip sections may include a first surface that faces its corresponding second clip member, while the second clip member for each of the first and second clip sections may include a second surface that faces its corresponding first clip member (e.g., the first surface of the first clip member and the second surface of the corresponding second clip member, for each of the first and second clip sections, may face or project toward one another). In one embodiment, the first surface of the first clip member for each of the first clip section and the second clip section includes at least one grounding projection of any appropriate type/configuration, while the second surface of the second clip member for each of the first clip section and the second clip section lacks a grounding projection of any type/configuration. The installed configuration for such an electrical bonding clip may be such that the first clip member for the first clip section is disposed on and engages an underside of the first metal panel (the second clip member of the first clip section being disposed on and engaging an exterior side of the first metal panel), and such that the first clip member for the second clip section is disposed on and engages an underside of the second metal panel (the second clip member of the second clip section being disposed on and engaging an exterior side of the second metal panel).

An electrical bonding clip including a first clip section and a second clip section that are spaced from one another may still be structurally interconnected by the structure of the electrical bonding clip. Such an electrical bonding clip may include a "plate" or a "base." One end portion of this plate/base (e.g., a first part of the plate/base) may define part of the first clip section (e.g., the first clip member for the first clip section), while an opposite end portion of this same plate/base (e.g., a second part of the plate/base) may define part of the second clip section (e.g. the first clip member for the second clip section). A third part of the plate/base may extend between the first part of the plate/base and the second part of the plate/base. Notwithstanding the characterization of the plate/base having these first, second, and third parts, the plate may be an integral structure (e.g., no joint between the noted first and third parts of the plate/base, and no joint between the noted second and third parts of the plate/base). Another characterization for an electrical bonding clip having a first clip section and a second clip section that are spaced from one another and a plate/base is that the first clip member for the first clip section is disposed at one end of the plate/base in the lateral dimension for the installed configuration of the electrical bonding clip, while the first clip member for the second clip section is disposed at an opposite end of the plate/base in this same lateral dimension.

A plate/base for the electrical bonding clip in accordance with any of the foregoing may be disposed on an underside of the panel assembly (e.g., a side of the panel assembly that is opposite of the side that is exposed to the environment/elements) for the installed configuration of the electrical bonding clip. In the case where the electrical bonding clip includes a first clip section and a second clip section that are spaced from one another, the electrical path may be from the first metal panel to the first clip member of the first clip section (including via one or more grounding projections of the first clip member of this first clip section that engages the underside of the first metal panel), from the first clip member of the first clip section to the first clip member of the second clip section via the intermediate portion of the plate/base, and from the first clip member of the second clip section to the second metal panel (including via one or more grounding projections of the first clip member of this second clip section that engages the second metal panel).

One or more aspects of the present invention are also addressed by the following paragraphs:

1. A panel assembly, comprising a first metal panel comprising a first edge portion;

second metal panel comprising a second edge portion;

a standing seam defined by an interconnection of said first edge portion and said second edge portion of said first metal panel and said second metal panel, respectively; and an electrical bonding clip that engages at least part of said first metal panel and that engages at least part of said second metal panel, wherein said electrical bonding clip provides an electrical connection between said first metal panel and said second metal panel.

2. The panel assembly of paragraph 1, wherein said electrical bonding clip is formed entirely of stainless steel.
3. The panel assembly of paragraph 1, wherein said electrical bonding clip is formed entirely of a conductive metal or metal alloy.
4. The panel assembly of any of paragraphs 1-3, wherein said electrical bonding clip is of an integral construction.
5. The panel assembly of any of paragraphs 1-4, wherein said electrical bonding clip comprises a first clip member, a second clip member disposed in opposing relation to said first clip member, and a living hinge between said first clip member and said second clip member.
6. The panel assembly of paragraph 5, wherein said first clip member is biased toward said second clip member.
7. The panel assembly of any of paragraphs 5-6, wherein said first clip member comprises a first surface that faces said second clip member and that comprises a first grounding projection, and wherein said second clip member comprises a second surface that faces said first clip member and that comprises a second grounding projection.
8. The panel assembly of paragraph 7, wherein each of said first grounding projection and said second grounding projection is configured to break a coating of said panel assembly.
9. The panel assembly of any of paragraphs 1-8, wherein said electrical bonding clip engages overlapping portions of said first metal panel and said second metal panel that define at least part of said standing seam.
10. The panel assembly of any of paragraphs 1-9, wherein said electrical bonding clip engages said standing seam.
11. The panel assembly of any of paragraphs 1-10, wherein said electrical bonding clip engages a section of said standing seam that is disposed orthogonal to a pitch defined by said panel assembly.
12. The panel assembly of any of paragraphs 1-4, wherein said electrical bonding clip comprises first and second clip sections, wherein said first clip section engages only said first metal panel, and wherein said second clip section engages only said second metal panel.
13. The panel assembly of paragraph 12, wherein said first clip section engages said first metal panel at a location that is spaced from said standing seam and said second clip section engages said second metal panel at a location that is spaced from said standing seam.
14. The panel assembly of paragraph 13, wherein said standing seam is located between said first clip section and said second clip section in a lateral dimension that is orthogonal to a length dimension of said standing seam that coincides with a pitch of said panel assembly.
15. The panel assembly of any of paragraphs 12-14, wherein each of said first clip section and said second clip section comprise a first clip member, a second clip member disposed in opposing relation to its corresponding said first clip member, and a living hinge between said first clip member and its corresponding said second clip member.

16. The panel assembly of paragraph 15, wherein said first clip member is biased toward its corresponding said second clip member for each of said first and second clip sections.
17. The panel assembly of any of paragraphs 15-16, wherein said first clip member for each of said first and second clip sections comprises a first surface that faces its corresponding said second clip member and that comprises at least one first grounding projection, wherein said second clip member for each of said first and second clip sections comprises a second surface that faces its corresponding said first clip member, and wherein said second surface of said second clip member for each of said first and second clip sections lacks any type of grounding projection.
18. The panel assembly of paragraph 17, wherein each said first grounding projection is configured to break a coating of said panel assembly.
19. The panel assembly of any of paragraphs 17-18, wherein said first clip member for said first clip section is disposed on and engages an underside of said first metal panel, and wherein said first clip member for said second clip section is disposed on and engages an underside of said second metal panel.
20. The panel assembly of any of paragraphs 15-19, wherein electrical bonding clip comprises a plate which in comprises said first clip member for said first clip section and said first clip member for said second clip section.
21. The panel assembly of paragraph 20, wherein said first clip member for said first clip section is disposed at one end of said plate in a lateral dimension that is orthogonal to a length dimension of said standing seam that coincides with a pitch of said panel assembly, wherein said first clip member for said second clip section is disposed at an opposite end of said plate in said lateral dimension, and wherein said plate comprises an intermediate portion that is located between said first clip member for said first clip section and said first clip member for said second clip section in said lateral dimension and that is disposed under said standing seam.
22. The panel assembly of any of paragraphs 12-14, wherein said electrical bonding clip comprises a plate, wherein a first part of said plate defines one part of said first clip section, and wherein a second part of said plate defines one part of said second clip section.
23. The panel assembly of paragraph 22, wherein said plate is disposed on an underside of said panel assembly.
24. The panel assembly of any of paragraphs 22-23, wherein said plate further comprises a third part that is located between said first part and said second part in a lateral dimension that is orthogonal to a length dimension of said standing seam that coincides with a pitch of said panel assembly, and wherein said third part of said plate is disposed under said standing seam.

DETAILED DESCRIPTION

Figure 1:
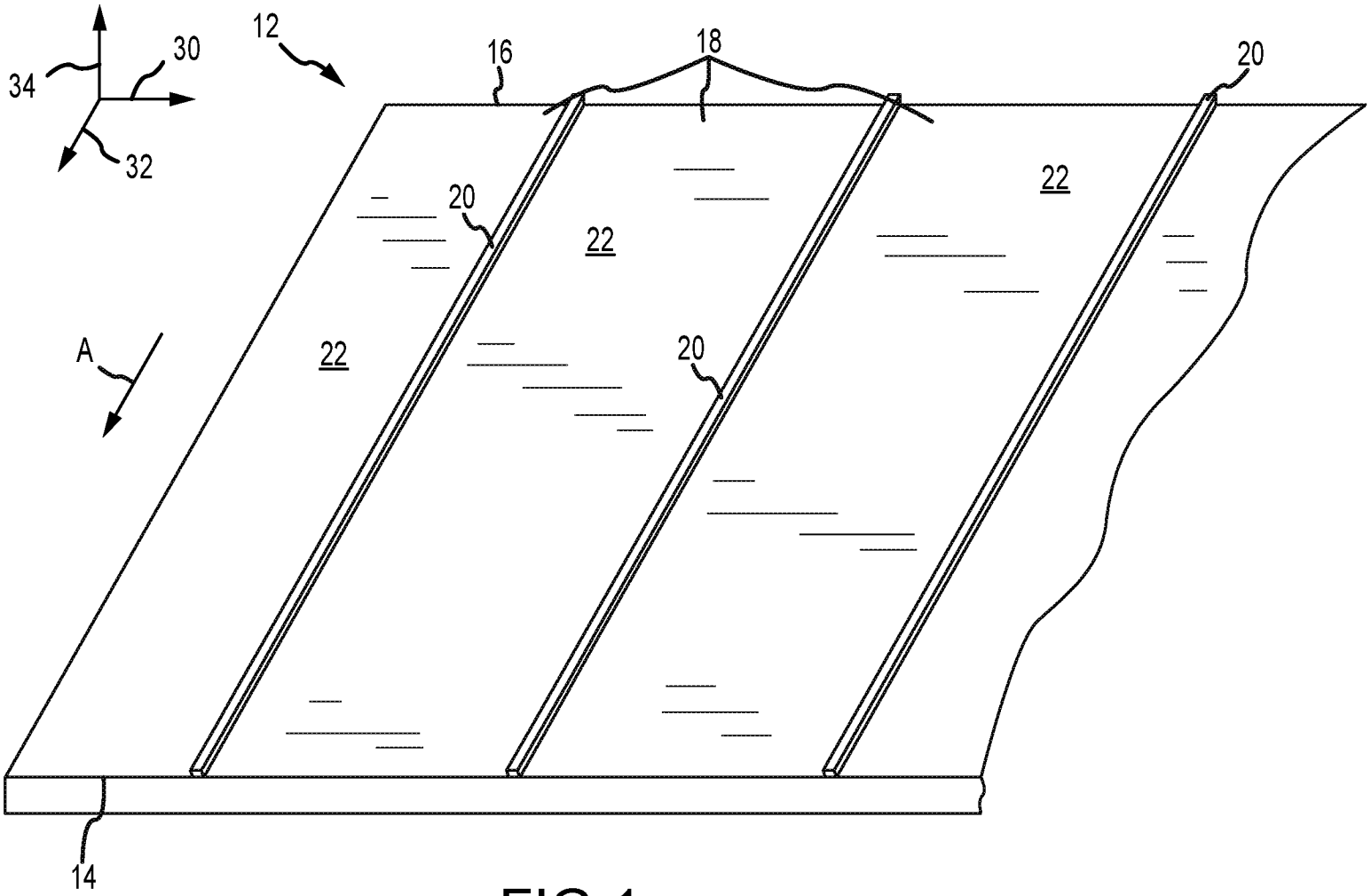
FIG.1 (Prior Art)
FIG. 1 is a perspective view of a prior art roofing surface defined by a plurality of interconnected panels, where each interconnection of adjacent pairs of panels defines a standing seam.

FIG. 1 illustrates a representative building/roofing surface 12. Generally, the roofing surface 12 may be defined in any appropriate manner and may be of any appropriate configuration. For instance, the roofing surface 12 may include one or more roofing sections, each of which may be of any appropriate pitch/slope and/or shape/size. The roofing surface 12 shown in FIG. 1 at least generally slopes downwardly in a direction denoted by arrow A from a peak 16 of the roofing surface 12 to an edge 14 of the roofing surface 12. Multiple panels 18 (e.g., metal panels) collectively define the roofing surface 12. The interconnection of each adjacent pair of panels 18 in the illustrated embodiment defines a standing seam 20 (only schematically illustrated in FIG. 1).

The standing seams 20 may at least generally proceed in the direction of or along the slope or pitch of the roofing surface 12 (e.g., the pitch of the length dimension of the standing seams 20 may match the pitch of the corresponding portion of the overall roofing surface 12). Each panel 18 includes at least one base section 22 that is at least generally flat or planar and that is disposed between each adjacent pair of standing seams 20 on the roofing surface 12. Each panel 18 could include one or more crests, minor ribs, intermediate ribs, partial ribs, striations, fluting, or flutes between its corresponding pair of standing seams 20 so as to provide multiple base sections 22 on each panel 18 (not shown).

The panels 18 may be of any appropriate configuration so to allow them to be interconnected or nested in a manner that defines a standing seam 20, and the standing seams 20 may be disposed in any appropriate orientation relative to the base sections 22 of the panels 18 that define the standing seam 20. Generally, each standing seam 20 is a protrusion of some sort that is defined at least in part by an adjacent pair of metal panels 18. For instance, the standing seams 20 may be characterized as at least initially extending orthogonally (e.g., perpendicularly) relative to the base sections 22 of the corresponding panels 18 (or relative to a pitch of the corresponding portion of the roofing surface 12). The illustrated standing seams 20 may be characterized as having a vertical end section, or as being of a vertical standing seam configuration. However, the end sections of the various standing seams 20 could also have portions that are horizontally disposed (e.g., at least generally parallel with the base sections 22 of the corresponding panels 18; at least generally parallel to a pitch of the corresponding portion of the roofing surface 12), or as being of a horizontal standing seam configuration.

FIG. 1 also shows a lateral dimension 30, a longitudinal dimension 32, and a vertical dimension 34. As such and in accordance with these coordinates: 1) the standing seams 20 are spaced from one another in the lateral dimension 30; 2) the length of the standing seams 20 is disposed in the longitudinal dimension 32 (e.g., extending between the peak 16 and edge 14 of the roofing surface 12); and 3) at least part of the standing seams 20 protrude in the vertical dimension 34 relative to adjacently-disposed base sections 22.

Figure 2A:
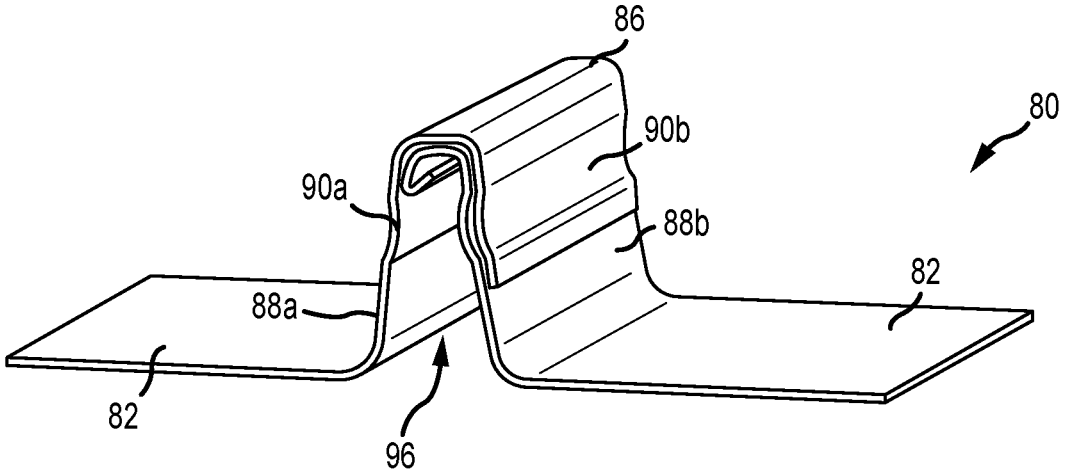
FIG.2A (Prior Art)
FIG. 2A is a perspective view of one prior art standing seam panel assembly configuration, where the standing seams are in the form of hollow seam ribs.
Figure 2B:
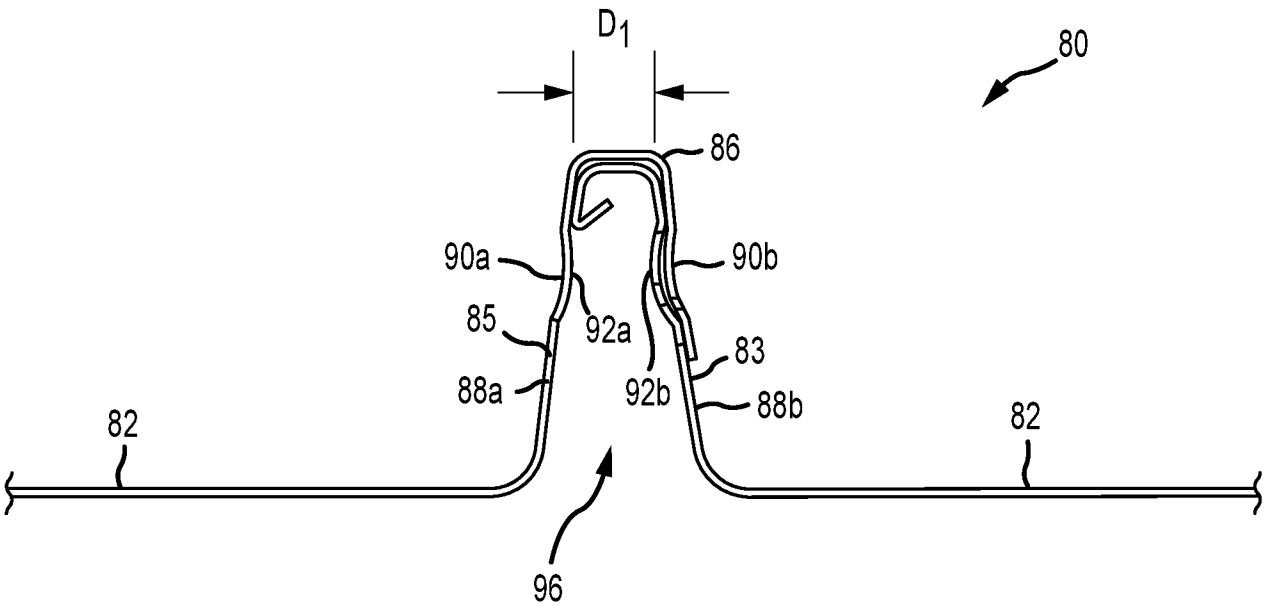
FIG.2B (Prior Art)
FIG. 2B is an end view of a standing seam of the prior art standing seam panel assembly of FIG. 2A.

As noted, an edge portion (or longitudinal edge portion) of one panel may be interconnected with an edge portion (or longitudinal edge portion) of an adjacent panel to define a standing seam. Various types of standing seam configurations exist. One type of standing seam configuration has a larger space within the standing seam and may be referred to as a hollow seam rib configuration. FIGS. 2A and 2B illustrate one type of a panel assembly 80 that may be used to define a building or roofing surface, and that uses one type of hollow seam rib configuration. The panel assembly 80 of FIGS. 2A and 2B is defined by a plurality of panels 82. Each panel 82 includes a left seam rib section 83 (a rib section used to define a hollow seam rib 86), along with a right seam rib section 85 (a rib section used to define a standing seam 86). The left seam rib section 83 and right seam rib section 85 of a given panel 82 are spaced in the width dimension of the panel 82 (or in the lateral dimension 30). Each panel 82 may include one or more flat sections, as well as one or more other structures such as crests, minor ribs, intermediate ribs, pencil ribs, striations, fluting, or flutes. Generally, the right seam rib section 85 for the left panel 82 in the view of FIG. 2B may be positioned over the left seam rib section 83 for the right panel 82 illustrated in the view of FIG. 2B to define a standing seam in the form of a hollow seam rib 86. Multiple panels 82 may be interconnected in this same general manner to define a panel assembly 80 of a desired size (both in the length dimension (longitudinal dimension 32) and width dimension (lateral dimension 30)).

Each hollow seam rib 86 of the panel assembly 80 may be characterized as having a first sidewall 88*a* and an oppositely disposed second sidewall 88*b* that are disposed in spaced relation (spaced in the lateral dimension 30). The first sidewall 88*a* includes an indentation 90*a* on an exterior of the seam rib 86, while the second sidewall 88*b* includes an indentation 90*b* on an exterior of the seam rib 86. The indentations 90*a* and 90*b* are disposed in opposing relation (e.g., disposed along a common axis that is orthogonal to the height of the hollow seam rib 86).

The seam rib 86 is of a hollow configuration, and includes an open space 96. A portion 92*a* of an internal surface of the seam rib 86 that is opposite of the indentation 90*a* (on the exterior of the seam rib 86) is spaced from a portion 92*b* of an opposing internal surface of the seam rib 86 that is opposite of the indentation 90*b* (on the exterior of the seam rib 86). In one embodiment, the portions 92*a*, 92*b* of the opposing internal surfaces of the seam rib 86 are separated by a distance $D_1$ of at least about 0.35 inches (prior to being engaged by any seam fasteners not shown) and that is measured in the lateral dimension 30. In one embodiment, the portions 92*a*, 92*b* of the opposing internal surfaces of the seam rib 86 are separated by a distance $D_1$ within a range of about 0.35 inches to about 0.75 inches. The open space 96 occupies the entire distance between the portions 92*a*, 92*b* of the opposing internal surfaces of the hollow seam rib 86. No other structure exists in this open space 96 throughout the entirety of the span between the portions 92*a*, 92*b* for the illustrated embodiment.

Exposed metal components of various types of equipment may be installed on a standing seam panel assembly of the types described herein and may become electrically energized, which in turn may electrically energize the standing seam panel assembly. In this regard, disclosed herein are various embodiments of standing seam panel assemblies that utilize an electrical bonding clip to establish an electrical path between adjacent pairs of panels that define a standing seam, and that may be used to electrically ground the standing seam panel assembly.

One embodiment of a standing seam panel assembly is illustrated in FIGS. 3A-3E and is identified by reference numeral 100. The panel assembly 100 includes a plurality of panels 82' (e.g., metal or metal alloy) that are interconnected with one another. The interconnection between each adjacent pair of panels 82' of the panel assembly 100 defines a standing seam 102 (a length dimension of the standing seam 102 (coinciding with the longitudinal dimension 32) typically being orthogonal to the lateral dimension 30 addressed below, and would also typically coincide with a pitch of a roofing surface that includes the panel assembly 100). At least one electrical bonding clip 104 may be installed on each standing seam 102 of the panel assembly 100, including on each adjacent pair of panels 82' for the standing seam panel assembly 100. Generally, each electrical bonding clip 104 of the panel assembly 100 electrically connects the corresponding pair of panels 82'. It should be appreciated any appropriate number of panels 82' may be interconnected in the manner embodied by FIGS. 3A-3E to define a standing seam panel assembly 100 of any appropriate size and/or configuration.

Figure 3A:
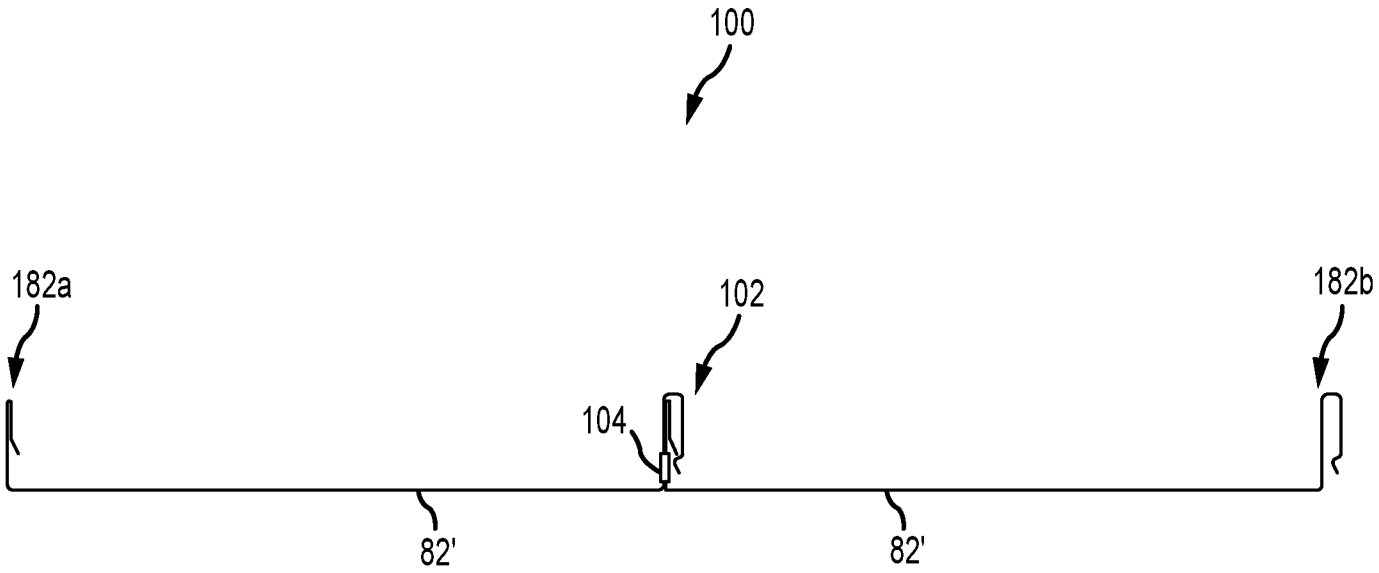
FIG. 3A is an end view of one embodiment of a standing seam panel assembly, where one embodiment of an electrical bonding clip is installed on a standing seam of the standing seam panel assembly.
Figure 3B:
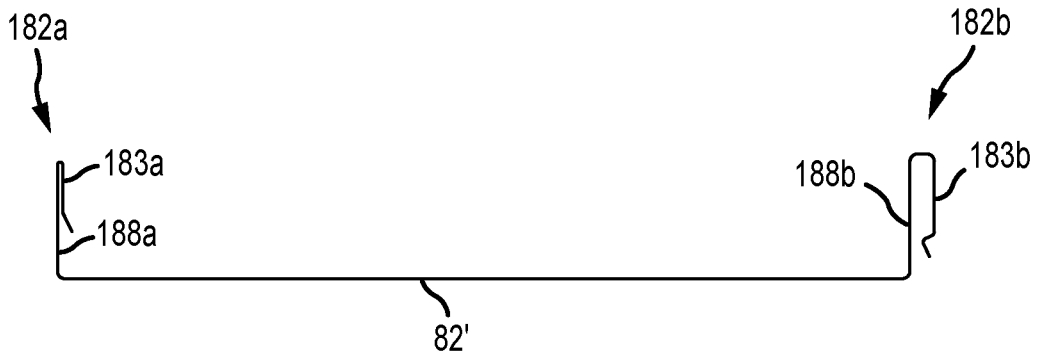
FIG. 3B is an end view of a panel used by the standing seam panel assembly of FIG. 3A.

The panels 82' of the standing seam panel assembly 100 are interconnected to define a standing steam 102 that is of a configuration that is different from the hollow seam rib configuration depicted in FIGS. 2A and 2B. Referring to FIGS. 3A and 3B, a right edge section (or a right longitudinal edge section) 182*b* of one panel 82' may be disposed over a left edge section (or a left longitudinal edge section) 182*a* of an adjacent panel 82' to define a standing seam 102. The left edge section 182*a* includes a sidewall 188*a* that extends upwardly when the corresponding panel 82' is horizontally disposed (e.g., disposed/oriented orthogonal to the pitch of the corresponding roofing surface; extending away from a reference plane that contains the main body of the corresponding panel 82'), along with an end section 183*a* that extends downwardly when the corresponding panel 82' is horizontally disposed (extending toward a reference plane that contains the main body of the corresponding panel 82'). The sidewall 188*a* and the end section 183*a* of the left edge section 182*a* are interconnected by an arcuate section, and with the end section 183*a* being disposed "inwardly" of the sidewall 188*a* in the lateral dimension 30.

The right edge section 182*b* includes a sidewall 188*b* that extends upwardly when the corresponding panel 82' is horizontally disposed (e.g., disposed orthogonal to the pitch of the corresponding roofing surface; extending away from a reference plane that contains the main body of the corresponding panel 82'), along with an end section 183*b* that extends downwardly when the corresponding panel 82' is horizontally disposed (extending toward a reference plane that contains the main body of the corresponding panel 82'). The sidewall 188*b* and the end section 183*b* of the right edge section 182*b* are interconnected by an arcuate section, and with the end section 183*b* being disposed "outwardly" of the sidewall 188*b* in the lateral dimension 30. In the illustrated embodiment, the spacing between the sidewall 188*b* and its corresponding end section 183*b* is larger than the spacing between the sidewall 188*a* and its corresponding end section 183*a*.

Each panel 82' further includes a first lateral edge or end 132 and a second lateral edge or end 136 that are spaced from one another, and each of which coincides with the lateral dimension 30. Typically the lateral dimension 30 will be that which coincides with a constant elevation when proceeding along a line in the lateral dimension 30 and when the panel assembly 100 is in an installed configuration to define a pitched roofing surface. In any case and as noted, a right edge section 182*b* of one panel 82' is disposed over a left edge section 182*a* of an adjacent panel 82' to define a standing seam 102 in the case of the panel assembly 100. At this time, the sidewall 188*b* of the right edge section 182*b* of one panel 82' may be disposed in closely spaced relation (and/or actually in interfacing relation) with the sidewall 188*a* of the left edge section 182*a* of the adjacent panel 82'. An electrical bonding clip 104 may be installed on the standing seam 102 of the panel assembly 100, namely on corresponding portions of the sidewall 188*b* of one panel 82' and the corresponding sidewall 188*a* of the adjacent panel 82' that collectively define a standing seam 102. In the case of the standing seam panel assembly 100, the electrical bonding clip 104 may be characterized as being installed in a vertical orientation.

Figure 3C:
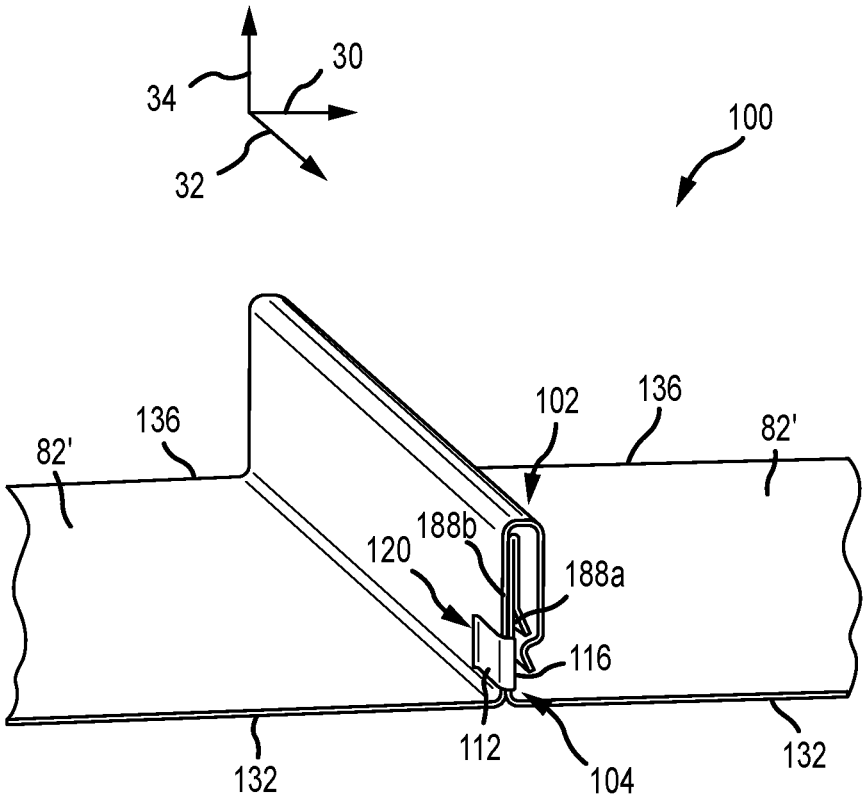
FIG. 3C is an enlarged perspective view of an electrical bonding clip that is installed on a standing seam of the standing seam panel assembly of FIG. 3A.
Figure 3D:
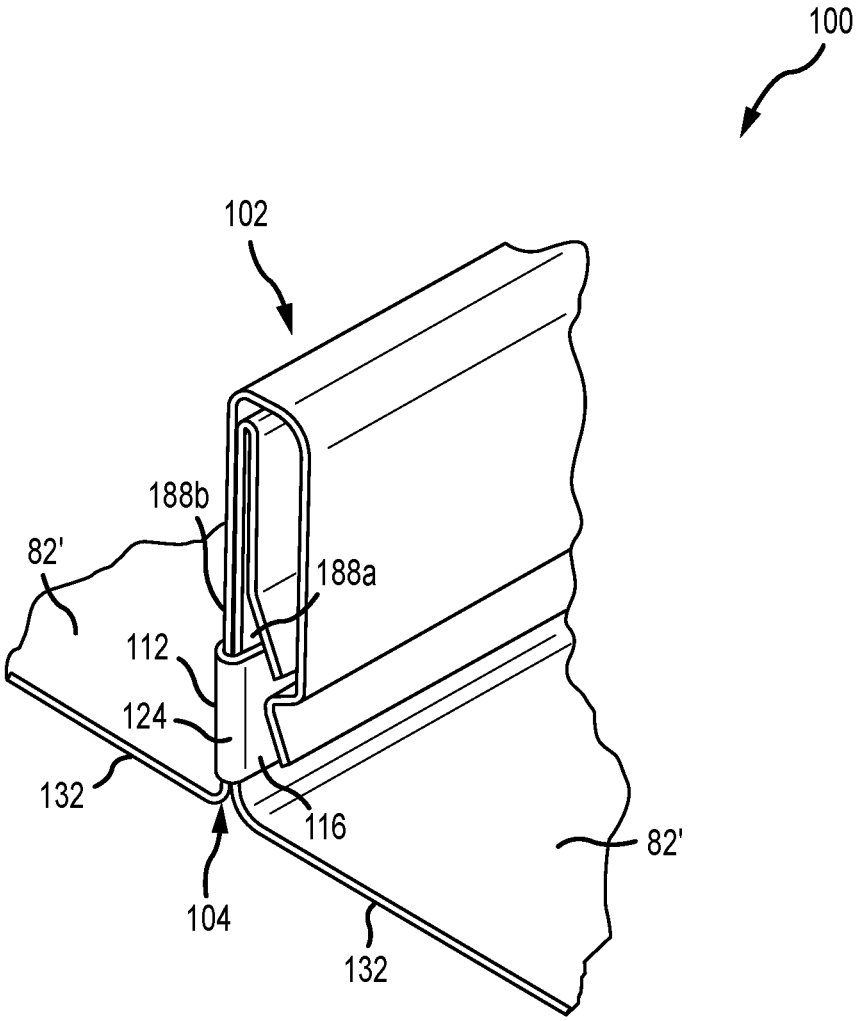
FIG. 3D is another enlarged perspective view of the electrical bonding clip and standing seam shown in FIG. 3C, viewed from an opposite side compared to FIG. 3C.
Figure 3E:
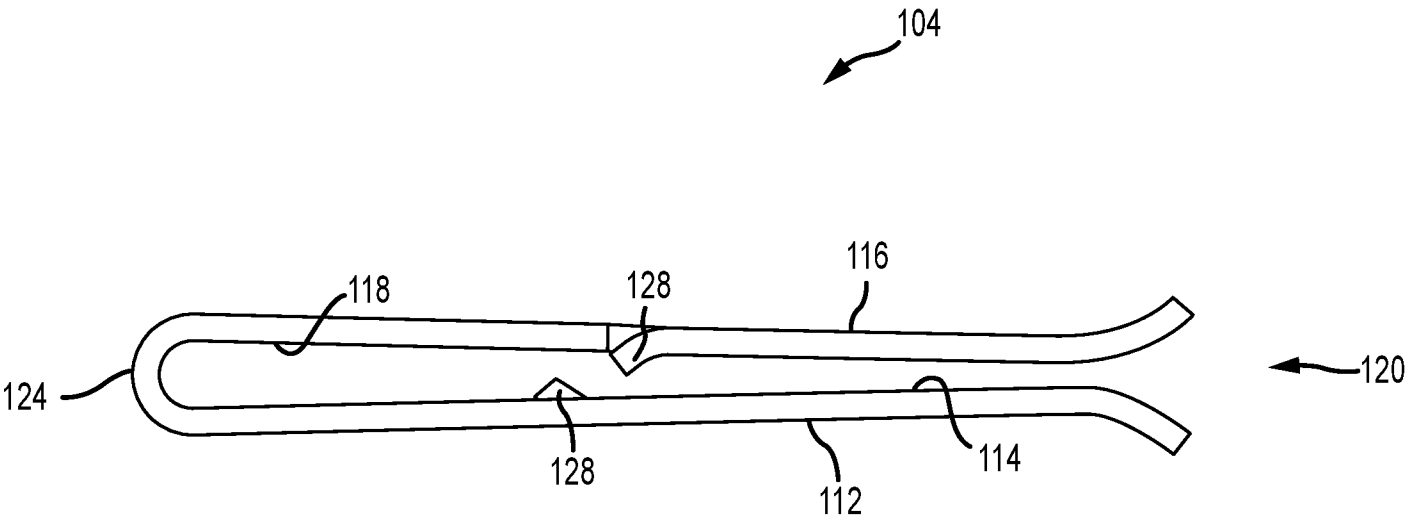
FIG. 3E is an enlarged side view of the electrical bonding clip used by the standing seam panel assembly of FIG. 3A.

Details of each electrical bonding clip 104 used by the standing seam panel assembly 100 are presented in FIGS. 3C-3E, and where each such electrical bonding 104 will typically be of the same configuration. As such, only one of the electrical bonding clips 104 will now be described. The electrical bonding clip 104 may be characterized as including a first clip member 112 and a second clip member 116 that is disposed in opposing relation to its corresponding first clip member 112. The first clip member 112 includes a first surface 114 that faces or projects toward the second clip member 116 (i.e., an interior surface of the electrical bonding clip 104) and that includes at least one electrical contact or grounding projection 128. The second clip member 116 includes a second surface 118 that faces or projects toward the first clip member 112 (i.e., an oppositely disposed interior surface 114 of the electrical bonding clip 104) and that includes at least one grounding projection 128. One end of the electrical bonding clip 104 is "open" and may be characterized as an inlet section 120 to the clip 104. The ends of the first clip member 112 and the second clip member 116 at the inlet section 120 may each flare in a direction away from one another to facilitate installation on a standing seam 102 as desired/required. An opposite end of the electrical bonding clip 104 is "closed" and may be characterized as a closed end or end section 124. In the case of the standing seam panel assembly 100 and as shown in FIGS. 3A, 3C, and 3D, the closed end 124 is vertically disposed/oriented when the clip 104 is installed on the corresponding standing seam 102 (e.g., disposed or oriented in the vertical dimension 34). At this time, one of the clip members 112, 116 will engage at least part of the sidewall 188*a* (one of the panels 82') for the corresponding standing seam 102, while the other of the clip members 112, 116 will engage at least part of the sidewall 188*b* (an adjacent panel 82') for the corresponding standing seam 102.

The first clip member 112 and the second clip member 116 of the electrical bonding clip 104 may be biased at least generally toward one another (e.g., via the elasticity of the end section 124 of the clip 104), including to the extent where the first clip member 112 and second clip member 116 are in contact with one another prior to being installed on a standing seam 102 of the panel assembly 100 (although such is not required). In any case, the spacing between the first clip member 112 and the second clip member 116 increases as/when the electrical bonding clip 104 is being installed on a standing seam 102. This "expansion" of the electrical bonding clip 104 may be realized by a flexing or bending (e.g., an elastic deformation) of the electrical bonding clip 104, may be characterized as a relative deflection of the first clip member 112 and the second clip member 116 at least generally away from one another, or both. For instance, the end section 124 of the electrical bonding clip 104 may be characterized as a "living hinge" (e.g., an arcuately-shaped, elastically-deformable, pliable portion) that allows relative movement between and interconnects the first clip member 112 and the second clip member 116. As such, the first clip member 112 and the second clip member 116 of the electrical bonding clip 104 may be characterized as being relatively deflectable away from one another (e.g., the second clip member 116 of the electrical bonding clip 104 may at least generally move away from the first clip member 112 by an elastic deformation of an interconnecting portion of the electrical bonding clip 104, for instance the noted living hinge in the form of the end section 124; pivotal or pivotal-like motion at least generally about the end section 124).

The first clip member 112 and the second clip member 116 of the electrical bonding clip 104 may at least at some point in time be biased toward one another as noted, and again this biasing force may be provided by the end section 124 (e.g., an elastic configuration). During at least a portion of the relative movement of the first clip member 112 and the second clip member 116 away from one another, the amount of biasing force may progressively increase (e.g., by an elastic "flexing" of the corresponding end section 124). Although a biasing force could be exerted on one or more of the first clip member 112 and the second clip member 116 prior to being installed on a standing seam 102 (including when the clip members 112, 116 are in contact with one another), such may not be required.

Referring now to FIG. 3E, the electrical bonding clip 104 may incorporate at least one electrical contact or grounding projection 128 on the first surface 114 of the first clip member 112, and at least one grounding projection 128 on the second surface 118 of the second clip member 116. These grounding projections 128 may be used to establish electrical connectivity between the two panels 82' that are engaged by the electrical bonding clip 104 via being installed on the corresponding standing seam 102. At least one grounding projection 128 of the first clip member 112 will engage (and be in electrical contact with) one of the panels 82' that define the standing seam 102 on which the clip 104 is mounted (either its sidewall 188*a* or its sidewall 188*b*), while at least one grounding projection 128 of the second clip member 116 will engage (and be in electrical contact with) the other of the panels 82' that define the standing seam 102 on which the clip 104 is mounted (either its sidewall 188*a* or its sidewall 188*b*). Each of the grounding projections 128 that are used by the electrical bonding clip 104 may be of a size, shape, and/or configuration, but are preferably configured so as to scratch the corresponding surface of the standing seam 102 as the clip 104 is being installed on the standing seam 102. This should enhance/allow electrical communication between the first clip member 112 and the panel 82' that is engaged thereby (at the standing seam 102—either its sidewall 188*a* or sidewall 188*b*), and which should enhance/allow electrical communication between the second clip member 116 and the panel 82' that is engaged thereby (at the standing seam 102—either its sidewall 188*a* or sidewall 188*b*). The clip members 112, 116 may be characterized as engaging opposed surfaces of overlapping portions of the two panels 82' that define at least part of the standing seam 102.

The noted grounding projections 128 for the first surface 114 and second surface 118 of the electrical bonding clip 104 may be characterized as providing electrical continuity between standing seam panels that are engaged by the electrical bonding clip 104 (e.g., an electrical path may encompass a first panel 82' engaged with one or more grounding projections 128 on the first surface 114 of the electrical bonding clip 104, the first surface 114 of the electrical bonding clip 104 being electrically connected to the second surface 118 of the electrical bonding clip 104 through the end section 124, and one or more grounding projections 128 of the second surface 118 of the electrical bonding clip 104 being engaged with a second panel 82'). This may be referred to as "bonding" or "electrically bonding" a pair of adjacent panels 82'. In any case, the noted electrical connection provided by the grounding projections 128 of the electrical bonding clip 104 may be used to electrically connect standing seam panels, which in turn may be used to provide an electrical path to ground an entire building surface of standing seam panels (or any portion thereof).

The electrical bonding clip 104 may be formed of any appropriate material or combination of materials to establish an electrical connection between a pair of panels 82' that together define a standing seam 102 (e.g., a metal or a metal alloy, and including from an electrically conductive material). For example, the electrical bonding clip 104 may be formed entirely of stainless steel. Furthermore, the electrical bonding clip 104 may be fabricated in any appropriate manner. For instance, the electrical bonding clip 104 could be of a one-piece construction (e.g., being integrally formed from a piece of sheet metal).

In summary, an electrical bonding clip 104 of the panel assembly 100 may electrically engage overlapping portions of a first panel 82' and a second panel 82', namely at a standing seam 102 defined by the interconnection of these two panels 82'. In this regard, the electrical bonding clip 104 may be appropriate for installation on other standing seam configurations that are defined at least in part by overlapping portions from two adjacent panels, such as a double fold or double-folded standing seam configurations. The electrical bonding clip 104 provides what may be characterized as a "slide fit" for the pair of panels 82' on which the clip 104 is installed. In this regard, the inlet section 120 of the electrical bonding clip 104 will be aligned with the adjacently disposed sidewalls 188*a*, 188*b* for the two panels 82' at the lateral edges 132 of the two panels 82' (another clip 104 could be installed on the same standing seam 102 at the oppositely disposed lateral edges 136 of the panels 82' as desired/required). The electrical bonding clip 104 will then be advanced toward the standing seam 102 (e.g., at least generally in the direction of the opposing lateral edges 136 of the panels 82') to position the first clip member 112 on one side of the standing seam 102 and to position the second clip member 116 on the other side of the standing seam 102. The electrical bonding clip 104 may be slid onto the standing seam 102 in the noted manner until the end section 124 of the electrical bonding clip 104 engages the lateral edges 132 of the two panels 82' at the standing seam 102, although such may not be required in all instances.

In the embodiment shown in FIGS. 3C and 3D, the first clip member 112 of the electrical bonding clip 104 engages the sidewall 188*b* for the left panel 82', while the second clip member 116 of the clip 104 engages the sidewall 188*a* for the right panel 82' and in the views for FIGS. 3C and 3D, all as the clip 104 is slid onto a standing seam 102 in the noted manner. This installation may also increase the spacing between the first clip member 112 and the second clip member 116 as noted above, and which should generate a sufficient force so as to retain the electrical bonding clip 104 on the standing seam 102. Again, the first surface 114 of the first clip member 112 and the second surface 118 of the second clip member 116 each may include one or more grounding projections 128 (e.g., having one or more "sharp" edges). Such grounding projections 128 may facilitate establishing sufficient electrical contact with the corresponding panel 82' (e.g., by configuring such grounding projections 128 to break a coating on the panel assembly 100 as the electrical bonding clip 104 is installed on a standing seam 102 in the foregoing manner). That is, the sliding motion that is used to install the electrical bonding clip 104 on the standing seam 102 may slide one or more grounding projections 128 along each side of the standing seam 102 (and while remaining in contact therewith) to enhance the electrical path between the clip 104 and each of the panels 82' that are engaged by the clip 104.

When an electrical bonding clip 104 has been installed on a standing seam 102 in the noted manner, the two panels 82' may be characterized as being "bonded" or "electrically bonded" via the electrical bonding clip 104. A series of panels 82' that collectively define the panel assembly 100 may therefore be electrically connected by each associated electrical bonding clip 104, namely by installing at least one electrical bonding clip 104 on each adjacent pair of panels 82' that collectively define a corresponding standing seam 102. This electrical path may be used to ground the entire panel assembly 100 (e.g., by running a grounding wire from one or more of the panels 82' of the panel assembly 100 to ground, as each adjacent pair of standing seam panels 82' in the panel assembly 100 should be electrically interconnected by at least one electrical bonding clip 104). The noted electrical path includes the left metal panel 82' shown in FIGS. 3C and 3D, to the first clip member 112 (via the engagement of or more grounding projections 128 of the first clip member 112 that engages this left metal panel 82'), from the first clip member 112 to the second clip member 116 via the closed end section 124, and from the second clip member 116 to the right metal panel 82' shown in FIGS. 3C and 3D (including via one or more grounding projections 128 of the second clip member 116 that engages this right metal panel 82').

Figure 4:
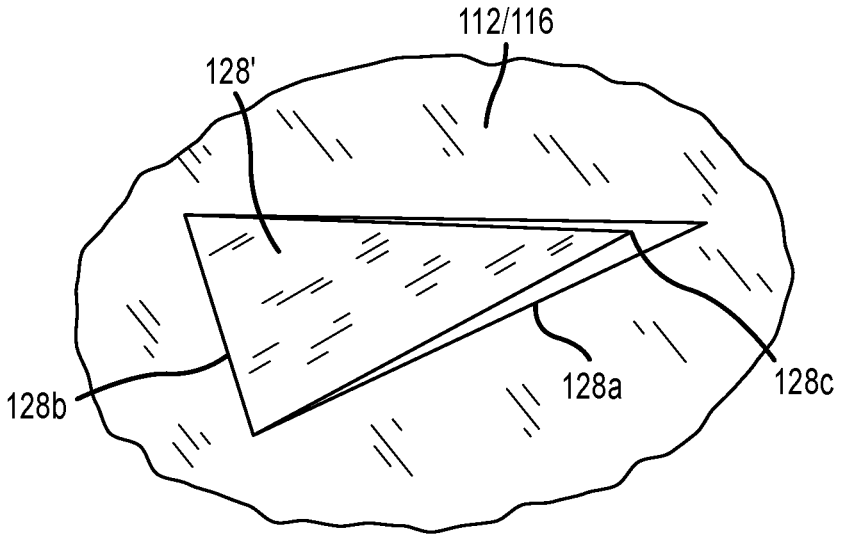
FIG. 4 is an enlarged perspective view of a grounding projection/electrical contact that may be used by an electrical bonding clip that is installed on a standing seam panel assembly.

FIG. 4 presents a representative configuration for the electrical contacts or grounding projections 128 used by the electrical bonding clip 104 of FIGS. 3A-3E. Other configurations may be appropriate. The electrical contact 128' shown in FIG. 4 cantilevers from a remainder of the corresponding clip member 112/116 of the electrical bonding clip 104 (e.g., each electrical contact 128' may be "punched" from the corresponding clip member 112/116). That is, the electrical contact 128' is partially separated from its corresponding clip member 112/116 to define an aperture 128*a*. The boundary between the electrical contact 128' and the remainder of the clip member 112/116 (where the electrical contact 128' remains attached to its corresponding clip member 112/116) is identified by reference numeral 128*b* in FIG. 4. The electrical contact 128' may flex or bend relative to the corresponding clip member 112/116 at least generally about this boundary 128*b*, and as such this may also be referred to as "hinge 128*b*."

In the illustrated embodiment, the electrical contact 128' is at least generally triangularly-shaped, and in any case extends toward the opposing clip member 112, 116 at an angle. Other configurations may be appropriate. A free end section or point 128*c* of the electrical contact 128' may be characterized as being disposed in the direction of the closed end section 124 of the electrical bonding clip 104, while the hinge 128*b* may be characterized as being disposed in the direction of the inlet 120. That is, the electrical contact 128' may be characterized as extending from its hinge 128*b* at least generally in the direction of the closed end section 124. As noted, the electrical contact 128' may also be characterized as extending from its hinge 128 associated with one of the clip members 112, 116, at least generally in the direction of the other of the clip members 112, 116.

Another embodiment of a standing seam panel assembly is illustrated in FIGS. 5A-5E and is identified by reference numeral 200. The panel assembly 200 includes a plurality of panels 82" (e.g., metal or metal alloy) that are interconnected with one another. Each panel 82" includes a first lateral edge or end 232 and a second lateral edge or end 236 that are spaced from one another in the longitudinal dimension 32. The interconnection between each adjacent pair of panels 82" of the panel assembly 200 defines a standing seam 202 (a length dimension of the standing seam 202 typically being orthogonal to the lateral dimension 30, and would typically coincide with a pitch of a roofing surface that includes the panel assembly 200). At least one electrical bonding clip 204 may be installed for each standing seam 202 used by the panel assembly 200, including for each adjacent pair of panels 82" of the standing seam panel assembly 200 that are interconnected to define a standing seam 202. Generally, each electrical bonding clip 204 of the panel assembly 200 electrically connects each pair of panels 82" that are interconnected to define a standing seam 202. It should be appreciated any appropriate number of panels 82" may be interconnected in the manner embodied by FIGS. 5A-5E to define a standing seam panel assembly 200 of any appropriate size and/or configuration.

The electrical bonding clips 104 used by the standing seam panel assembly 100 of FIGS. 3A-3E are each installed directly on a standing seam 102 in accordance with the foregoing. That is not the case for the electrical bonding clips 204 used by the standing seam panel assembly 200 of FIGS. 5A-5E. Generally, each electrical bonding clip 204 for the embodiment of FIGS. 5A-5E separately engages each panel 82" that defines a standing seam 202 on each of the two sides of the standing seam 202, not on the standing seam 202 itself. As such and as will be addressed in more detail below, one portion of a given electrical bonding clip 204 will be positioned on one side of the corresponding standing seam 202 (and engages only one of the two panels 82" that defines this standing seam 202), while another portion of this same electrical bonding clip 204 will be positioned on the opposite side of this same standing seam 202 (and engages only the other of the two panels 82" that defines this same standing seam 202).

Figure 5A:
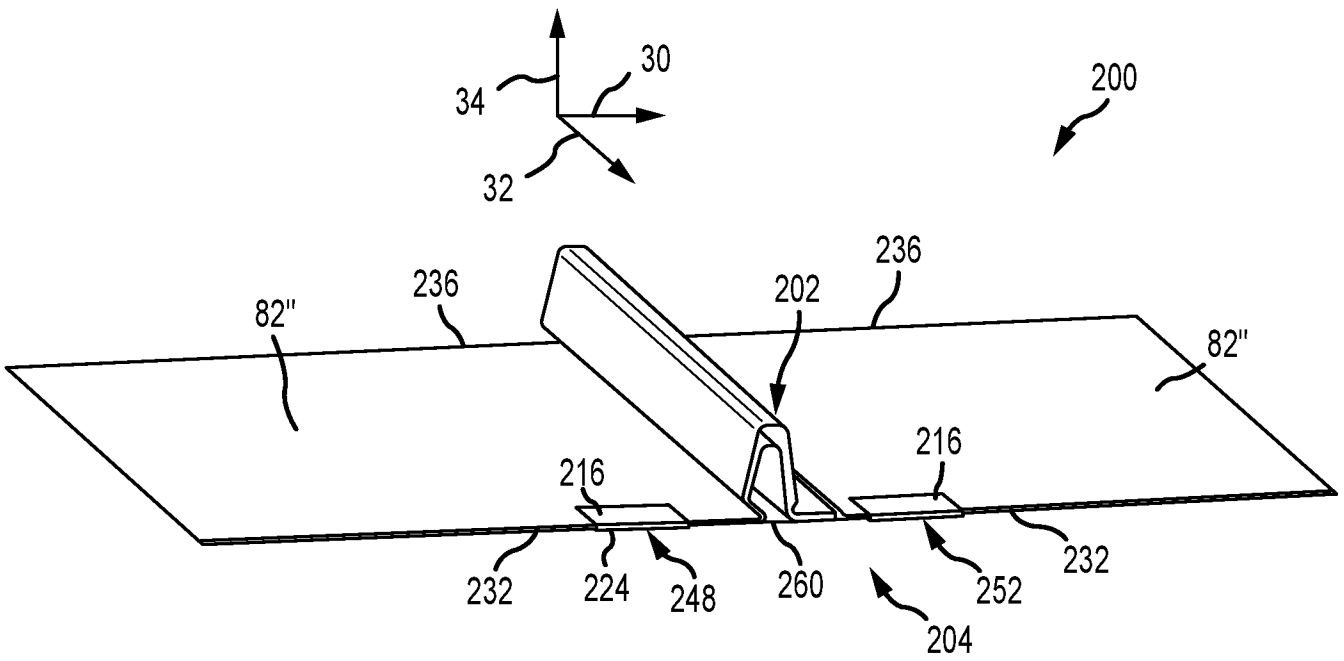
FIG. 5A is a perspective top view of another embodiment of a standing seam panel assembly, where another embodiment of an electrical bonding clip engages an adjacent pair of panels on opposite sides of a corresponding standing seam.
Figure 5B:
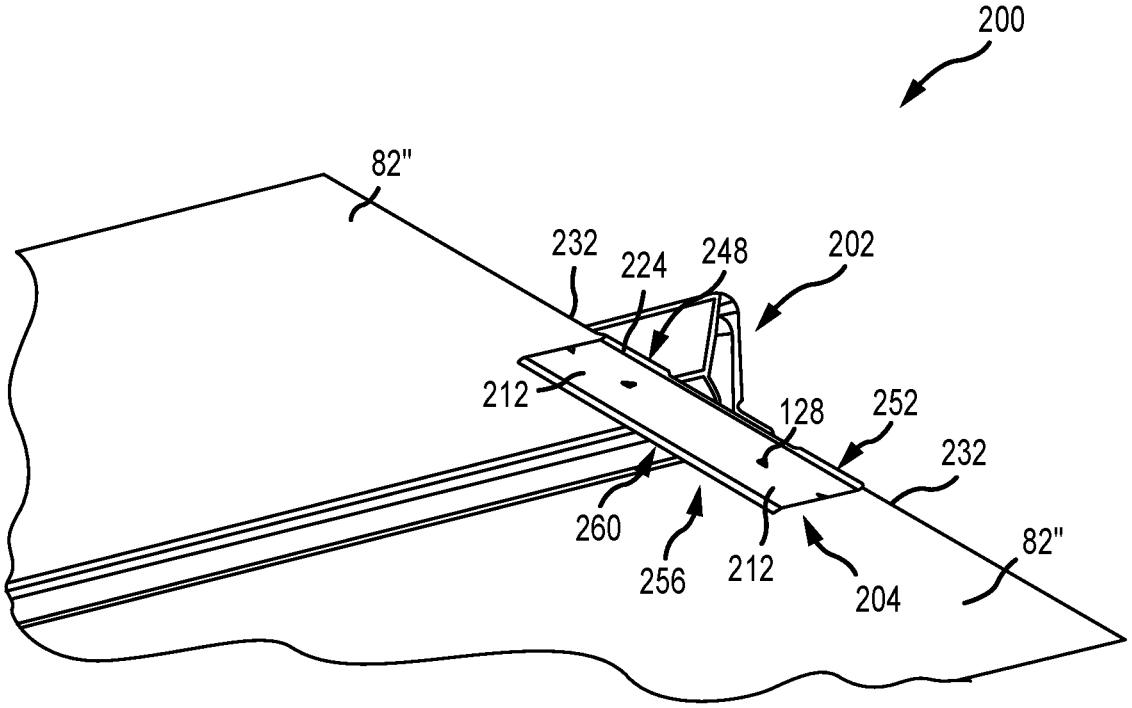
FIG. 5B is a perspective bottom view of a portion of the standing seam panel assembly of FIG. 5A that incorporates an electrical bonding clip.

Referring now primarily to FIGS. 5A and 5B, a pair of panels 82" of the standing seam panel assembly 200 are shown as being interconnected to define a standing seam 202. The standing seam 202 in this case is in the form of a hollow seam rib. A different hollow seam rib configuration is shown in FIGS. 2A and 2B and was addressed above. The electrical bonding clip 204 can be used with any hollow seam rib configuration (including that which is presented in FIGS. 2A and 2B), and in fact could be used with the standing seam configuration used by the standing seam panel assembly 100 of FIGS. 3A-3E (or any other standing seam configuration for that matter). Generally, the electrical bonding clip 204 does not engage a standing seam, but instead separately engages the two panels that are on each side of this standing seam (where the two noted panels are interconnected to define this standing seam). In addition, the electrical bonding clip 204 is installed in a horizontal orientation (versus the vertical orientation used by the electrical bonding clip 104 for the panel assembly 100 of FIGS. 3A-3E).

The electrical bonding clip 204 of the panel assembly 200 includes a first clip section 248 and a second clip section 252 that are spaced from one another in the lateral dimension 30. The first clip section 248 is positioned on one side of the standing seam 202 and engages only one of the two panels 82" that defines this standing seam 202. In the view shown in FIGS. 5A and 5B, the first clip section 248 is positioned on the left side of the standing seam 202 and engages only the left panel 82". The second clip section 252 is positioned on the other side of the standing seam 202 and engages only one of the two panels 82" that defines this standing seam 202. In the view shown in FIGS. 5A and 5B, the second clip section 252 is positioned on the right side of the standing seam 202 and engages only the right panel 82". Any appropriate spacing may exist between the standing seam 202 and each of the clip sections 248, 252.

Figure 5C:
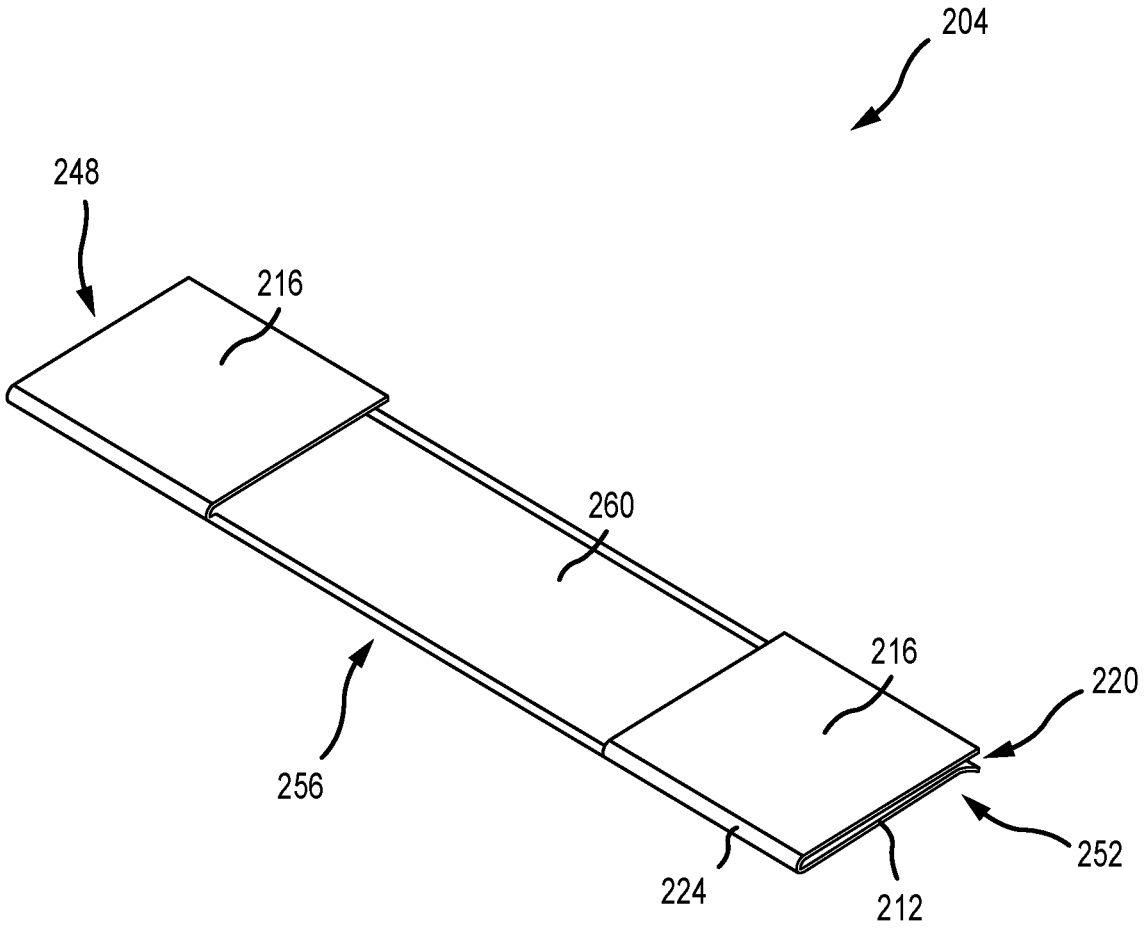
FIG. 5C is an enlarged perspective top view of an electrical bonding clip used by the standing seam panel assembly of FIG. 5A.
Figure 5D:
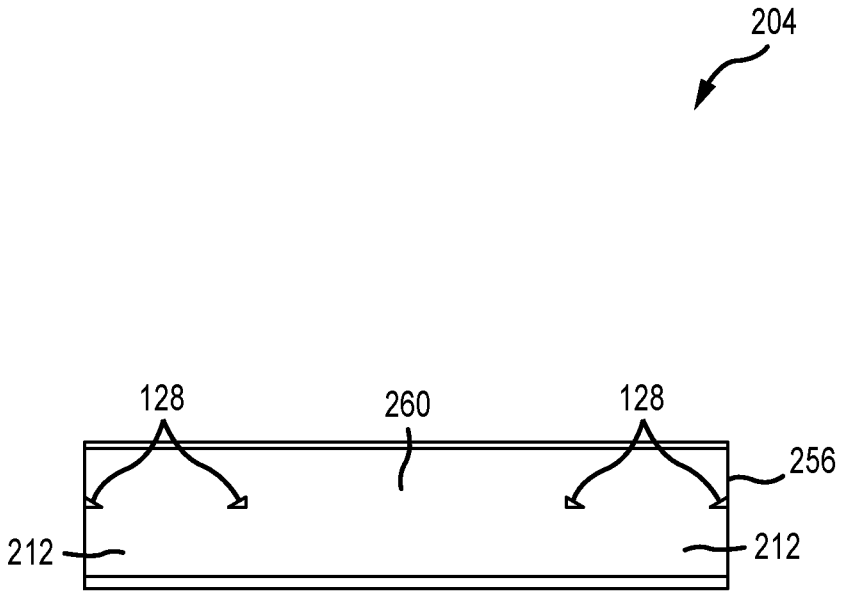
FIG. 5D is an enlarged bottom view of the electrical bonding clip shown in FIG. 5C.
Figure 5E:
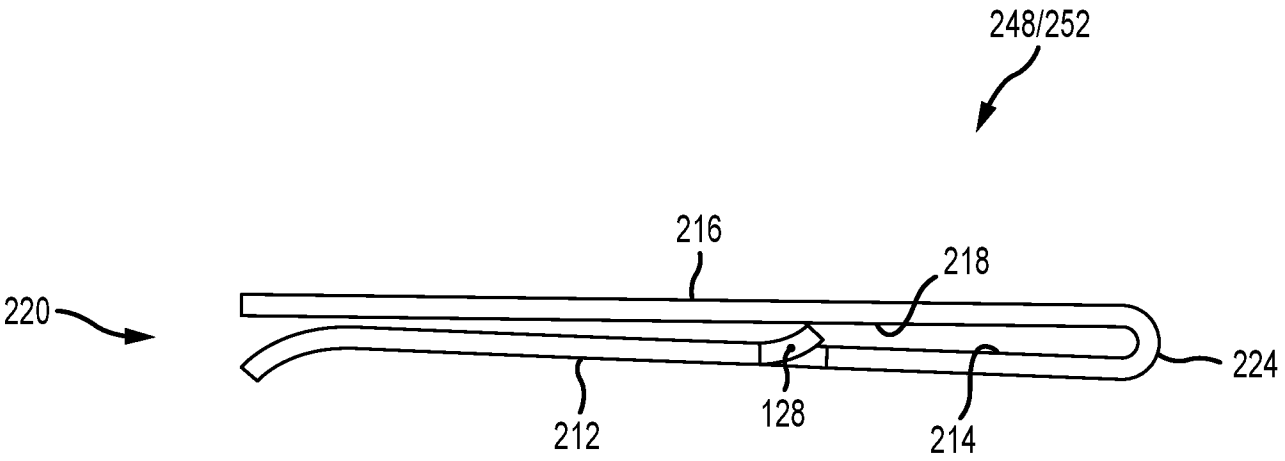
FIG. 5E is an enlarged side view of the electrical bonding clip shown in FIG. 5C.

Additional details of the electrical bonding clip are shown in FIGS. 5C-5E. Each of the first clip section 248 and the second clip section 252 includes a first clip member 212 and a second clip member 216 that are disposed in opposing relation to one another in the same manner as discussed above regarding the electrical bonding clip 104 of FIGS. 3A-3E. The discussion presented above regarding the electrical bonding clip 104 is thereby equally applicable to each of the first clip section 248 and the second clip section 252 of the electrical bonding clip 204 unless otherwise noted herein to the contrary. The electrical bonding clip 204 includes a plate or base 256 that is disposed on an underside of a pair of adjacently disposed panels 82" that are interconnected to define a standing seam 202 when the clip 204 is in an installed configuration. Generally, one part of the plate 256 defines one part of the first clip section 248 (its corresponding first clip member 212—discussed below), another part of this same plate 256 defines part of the second clip section 252 (its corresponding first clip member 212—discussed below), and yet another part of this same plate 256 is disposed under the standing seam 202 (an intermediate portion 260 that extends between the first clip member 212 for each of the first clip section 248 and the second clip section 252). The bottom plate 256 may be of any appropriate extent in the lateral dimension 30, and including where the bottom plate 256 extends beyond the first clip section 248 in the lateral dimension 30 and in a direction that is further away from the corresponding stand seam 202 (not shown) and/or including where the bottom plate 256 extends beyond the second clip section 252 in the lateral dimension 30 and in a direction that is further away from the corresponding stand seam 202 (not shown).

The first clip member 212 for each of the first clip section 248 and second clip section 252 includes a first surface 214 that faces or projects toward the corresponding second clip member 216 (i.e., an interior surface for the corresponding clip section 248, 252) and that includes at least one of the above-noted grounding projections 128. The second clip member 216 for each of the first clip section 248 and the second clip section 252 includes a second surface 218 that faces or projects toward the corresponding first clip member 212. In the illustrated embodiment, the second surface 218 of the second clip member 216 for each clip section 248, 252 lacks any type of grounding projection (e.g., in the form of a smooth surface). The first clip member 212 for each of the first clip section 248 and the second clip section 252 is disposed on and engages an underside (or interior side) of the corresponding panel 82", while the second clip member 216 for each of the first clip section 248 and the second clip section 252 is disposed on and engages a topside (or exterior side) of the corresponding panel 82". As the second clip member 216 for each of the first clip section 248 and the second clip section 252 does not include any ground projections in the illustrated embodiment, installation of the electrical bonding clip 204 should not scratch the top or upper surface of the corresponding panels 82" to any significant degree.

As illustrated in FIG. 5E, a common end for each of the first clip section 248 and second clip section 252 is "open" and may be characterized as an inlet section 220 to the corresponding clip section 248, 252. An opposite common end for each of the first clip section 248 and second clip section 252 is "closed" and may be characterized as an end section 224. A free end portion of the first clip member 212, at the inlet section 220 for each of the clip sections 248, 252 may flare or diverge away from the corresponding second clip member 216 to facilitate installation of the electrical bonding clip 204 on the panels 82" as desired/required. The entirety of each second clip member 216 may be an at least substantially planar structure such that when the electrical bonding clip 204 is engaged with a pair of panels 82", each second clip member 216 should be at least substantially flush (i.e., in contact) with a topside of the corresponding panel 82" (e.g., an exterior side of the panel 82").

In the case of the standing seam panel assembly 200 and as shown in FIGS. 5A and 5B, the end section 224 for each of the clip sections 248, 252 is horizontally disposed when installed on an adjacent pair of panels 82" that are interconnected to define a standing seam 202. As such, the second clip member 216 for each clip section 248, 252 will engage an upper surface of the corresponding panel 82" on each side of the corresponding standing seam 202, while the first clip member 212 for each of the clip sections 248, 252 will engage a lower/bottom surface (or the underside) of the corresponding panel 82" on each side of the corresponding standing seam 202.

The clip sections 248, 252 for the electrical bonding clip 204 will typically be of a common configuration. The following discussion is equally applicable to both clip sections 248, 252 unless otherwise noted. The first clip member 212 and the corresponding second clip member 216 may be biased at least generally toward one another (e.g., via the elasticity of the corresponding closed end 224), including to the extent where the first clip member 212 and the corresponding second clip member 216 are in contact with one another prior to being installed on an adjacent pair of panels 82" of the panel assembly 200 (although such is not required). In any case, the spacing between the first clip member 212 and the corresponding second clip member 216 increases as/when the electrical bonding clip 204 is installed on an adjacent pair of panels 82" of the panel assembly 200. This "expansion" of the clip sections 248, 252 may be realized by a flexing or bending (e.g., an elastic deformation) of the clip sections 248, 252, may be characterized as a relative deflection of the first clip member 212 and the corresponding second clip member 216 at least generally away from one another, or both. For instance, the end section 224 for each of the clip sections 248, 252 may be characterized as a "living hinge" (e.g., an arcuately-shaped, elastically-deformable, pliable portion) that allows relative movement between and interconnects a first clip member 212 and a corresponding second clip member 216. As such, the first clip member 212 and the corresponding second clip member 216 may be characterized as being relatively deflectable away from one another (e.g., the second clip member 216 may at least generally move away (relatively) from the corresponding first clip member 212 by an elastic deformation of an interconnecting portion of the corresponding clip section 248, 252, for instance the noted living hinge in the form of the corresponding end section 224; pivotal or pivotal-like motion at least generally about the end section 224).

The first clip member 212 and the corresponding second clip member 216 may at least at some point in time be biased toward one another as noted, and again this biasing force may be provided by the corresponding end section 224 disposed therebetween (e.g., an elastic configuration). During at least a portion of the relative movement of the first clip member 212 and the corresponding second clip member 216 away from one another, the amount of the biasing force may progressively increase (e.g., by an elastic "flexing" of the corresponding end section 224). Although a biasing force could be exerted on one or more of the first clip member 212 and the corresponding second clip member 216 prior to being installed on an adjacent pair of panels 82" of the panel assembly 200 (including when the corresponding clip members 212, 216 are in contact with one another), such is not required.

Referring now to FIG. 5E, the electrical bonding clip 204 may incorporate at least one electrical contact or grounding projection 128 on the first surface 214 of each first clip member 212. These grounding projections 128 may be used to establish electrical connectivity between the two panels 82" that are engaged by the electrical bonding clip 204 via engaging a panel 82" on each side of a standing seam 202 defined by a pair of adjacent panels 82". At least one grounding projection 128 of the first clip member 212 for the first clip section 248 will engage (and be in electrical contact with) one of the panels 82" associated with a particular standing seam 202, while at least one grounding projection 128 of the first clip member 212 for the second clip section 252 will engage (and be in electrical contact with) the other of the panels 82" associated with this same standing seam 202. This should accommodate/allow electrical communication between the first clip member 212 of the first clip section 248 and the panel 82" that is engaged thereby, and which should allow electrical communication between the first clip member 212 of the second clip section 252 and the panel 82" that is engaged thereby. The clip sections 248, 252 are electrically connected by the common bottom plate 256 of the clip 204.

The noted grounding projections 128 for the first surface 214 of the first clip member 212 for each of the clip sections 248, 252 of the electrical bonding clip 204 may be characterized as providing electrical continuity between a pair of standing seam panels that are engaged by the electrical bonding clip 204 (e.g., an electrical path may encompass one panel 82" being engaged by one or more grounding projections 128 of the first clip member 212 for the first clip section 248 of the electrical bonding clip 204, by the first clip member 212 for the first clip section 248 of the electrical bonding clip 204 being electrically connected with the first clip member 212 for the second clip section 252 of the electrical bonding clip 204 by the intermediate portion 260 of the bottom plate 256, and the adjacent panel 82" being engaged by one or more grounding projections 128 of the first clip member 212 for the second clip section 252 of the electrical bonding clip 204). Again, this may be referred to as "bonding" or "electrically bonding" an adjacent pair of panels 82". In any case, the noted electrical connection provided by the grounding projections 128 of the electrical bonding clip 204 may be used to electrically connect adjacent pairs of standing seam panels, which in turn may be used to provide an electrical path to ground an entire building surface of standing seam panels (or any discrete portion thereof).

The electrical bonding clip 204 may be formed of any appropriate material or combination of materials to establish an electrical connection between a pair of panels 82" that together define a standing seam 202 (e.g., a metal or a metal alloy, and including from an electrically conductive material). For example, the electrical bonding clip 204 may be formed entirely of stainless steel. Furthermore, the electrical bonding clip 204 may be fabricated in any appropriate manner. For instance, the electrical bonding clip 204 could be of a one-piece construction (e.g., being integrally formed from a piece of sheet metal).

In summary, an electrical bonding clip 204 electrically engages an adjacent pair of panels 82" other than at the standing seam 202 defined by this adjacent pair of panels 82" for the case of the panel assembly 200 of FIGS. 5A-5E. The electrical bonding clip 204 provides what may be characterized as a "slide fit" for an adjacent pair of panels 82" on which the clip 204 is to be installed. In this regard, the inlet section 220 of the clip section 248 will be aligned with a lateral edge 232 of the left panel 82" shown in FIG. 5A at a location other than at the standing seam 202, while the inlet section 220 of the clip section 252 will be aligned with a lateral edge 232 of the right panel 82" shown in FIG. 5A at a location other than at the standing seam 202 (another clip 204 could be installed in the same general manner, but on the oppositely disposed lateral edge 236 of the panels 82", as desired/required). The electrical bonding clip 204 will then be advanced to position a portion of the left panel 82" shown in FIG. 5A between the first clip member 212 and the second clip member 216 of the first clip section 248, and to position a portion of the right panel 82" shown in FIG. 5A between the first clip member 212 and the second clip member 216 of the second clip section 252 (e.g., a movement at least generally in the direction of the opposing lateral edge 236 of the corresponding panel 82"). The electrical bonding clip 204 may be slid onto the two panels 82" shown in FIG. 5A in the noted manner until the end section 224 of the first clip section 248 engages the lateral edge 232 of the left panel 82" shown in FIG. 5A and/or until the end section 224 of the second clip section 252 engages the lateral edge 232 of the right panel 82" shown in FIG. 5A, although such may not be required in all instances. As such, the first clip section 248 for the clip 204 will be positioned on the left side of the standing seam 202 shown in FIG. 5A, while the second clip section 252 for the clip 204 will be positioned on the right side of the standing seam 202 shown in FIG. 5A. Although the electrical grounding clip 204 may be installed such that the clip sections 248, 252 will be equally spaced from the standing seam 202, such need not be the case for all circumstances.

When an electrical bonding clip 204 has been installed on an adjacent pair of panels 82" in the above-noted manner, the two panels 82" may be characterized as being "bonded" or "electrically bonded" via the electrical bonding clip 204. A series of panels 82" that collectively define the panel assembly 200 may therefore be electrically connected by each associated electrical bonding clip 204, namely by installing at least one electrical bonding clip 204 on each adjacent pair of panels 82" that collectively define a corresponding standing seam 202. This electrical path may be used to ground the entire panel assembly 200 (e.g., by running a grounding wire from one or more of the panels 82" of the panel assembly 200 to ground, as each adjacent pair of standing seam panels 82" in the panel assembly 200 should be electrically interconnected by at least one electrical bonding clip 204). An electrical path in accordance with the embodiment of FIGS. 5A-5E may be from the left metal panel 82" in the views shown in FIGS. 5A and 5B, to the first clip member 212 of the clip section 248 (including via one or more grounding projections 128 of the first clip member 212 of the clip section 248 that engages the underside of this left metal panel 82"), from the first clip member 212 of the clip section 248 to the first clip member 212 of the clip section 252 via the intermediate portion 260 of the plate 256, and from the first clip member 212 of the clip section 252 to the right metal panel 82" in the view of FIGS. 5A and 5B (including via one or more grounding projections 128 of the first clip member 212 for the clip section 252 that engages this right metal panel 82").

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed:

1. An electrical bonding clip for providing an electrical connection between two or more metal panels that are a part of a panel assembly having a standing seam, the electrical bonding clip comprising:

a first clip member formed by a plate, the plate having an upper surface, a lower surface opposite the upper surface, a first part with a first end, a second part with a second end opposite the first end, and an intermediate portion positioned between and connecting the first part to the second part;

a first clip section formed by the first part of the plate and a second clip member spaced from the first part of the plate, wherein the second clip member is interconnected to the first part of the plate at a first living hinge, the first clip section having two free ends forming a first inlet section opposite the first living hinge, wherein the upper surface of the first part of the plate is facing toward a lower surface of the second clip member, wherein the second clip member lacks a grounding projection such that the lower surface of the second clip member defines a planar surface, and wherein the first clip member has at least one grounding projection extending toward the second clip member from the upper surface of the first part of the plate; and a second clip section formed by the second part of the plate and a third clip member spaced from the second part of the plate, wherein the third clip member is interconnected to the second part of the plate at a second living hinge that is spaced from the first living hinge by the intermediate portion of the plate, the second clip section having two free ends forming a second inlet section opposite the second living hinge, wherein the upper surface of the second part of the plate is facing toward a lower surface of the third clip member, wherein the third clip member lacks a grounding projection such that the lower surface of the third clip member defines a planar surface, and wherein the first clip member has at least one grounding projection extending toward the third clip member from the upper surface of the second part of the plate;

wherein the electrical bonding clip is formed entirely of an electrically conductive material.

2. The electrical bonding clip of claim 1, wherein the electrical bonding clip is configured to receive a first metal panel positioned within the first inlet section and a second metal panel positioned within the second inlet section with a standing seam that joins the first metal panel to the second metal panel positioned between the second clip member and the third clip member.

3. The electrical bonding clip of claim 2, wherein the first clip section is configured to engages the first metal panel at a first location on one side of the standing seam in a lateral direction and the second clip section is configured to engages the second metal panel at a second location on an opposite side of the standing seam in the lateral direction such that the intermediate portion of the plate is positioned below the standing seam, and wherein the electrical bonding clip is of an integral construction.

4. The electrical bonding clip of claim 2, wherein the electrical bonding clip is adapted to engage the panel assembly with the first living hinge in contact with a lateral edge of the first metal panel and with the second living hinge in contact with a lateral edge of the second metal panel, and wherein the lateral edges of the first and second metal panels are oriented orthogonally to the standing seam.

5. The electrical bonding clip of claim 1, wherein the electrical bonding clip is formed entirely of a conductive metal or metal alloy.

6. The electrical bonding clip of claim 1, wherein the plate further comprises:

a first lateral edge extending in a lateral direction between the first living hinge and the second living hinge; and a second lateral edge extending in the lateral direction from the first end to the second end.

7. The electrical bonding clip of claim 6, wherein the first clip member is biased toward the second clip member and the third clip member, and wherein the second lateral edge bends downwardly below a plane defined by the upper surface of the plate to facilitate installation of the electrical bonding clip onto the panel assembly.

8. The electrical bonding clip of claim 1, wherein the intermediate portion of the plate has a predetermined lateral dimension such that when the electrical bonding clip is engaged with the panel assembly an entirety of the standing seam connecting a first metal panel to a second metal panel is exposed relative to the electrical bonding clip and the second and third clip members are spaced from the standing seam.

9. A panel assembly comprising:

a panel section comprising:

a first metal panel having a first edge portion, an upper surface, and a lower surface opposite the upper surface;

a second metal panel having a second edge portion, an upper surface, and a lower surface opposite the upper surface;

a standing seam defined by an interconnection of the first edge portion and the second edge portion, the standing seam having a first side and a second side opposite the first side;

an exterior side comprising the standing seam and the upper surfaces of each of the first metal panel and the second metal panel; and an underside opposite the exterior side and comprising the lower surfaces of each of the first metal panel and the second metal panel;

an electrical bonding clip formed entirely of an electrically conductive material, the electrical bonding clip comprising:

a first clip member formed by a plate and having an upper surface, a lower surface opposite the upper surface, a first part with a first end, a second part with a second end opposite the first end, and an intermediate portion positioned between and connecting the first part to the second part;

a first clip section formed by the first part of the first clip member and a second clip member spaced from the first part of the first clip member, wherein the second clip member is interconnected to the first part of the first clip member at a first living hinge, the first clip section having two free ends forming a first inlet section opposite the first living hinge;

a second clip section formed by the second part of the first clip member and a third clip member spaced from the second part of the first clip member, wherein the third clip member is interconnected to the second part of the first clip member at a second living hinge, the second clip section having two free ends forming a second inlet section opposite the second living hinge; and an intermediate section extending between the first clip section and the second clip section, wherein the first living hinge is spaced from the second living hinge by the intermediate section, wherein the first clip section is disposed adjacent the first side of the standing seam and engages the upper and lower surfaces of the first metal panel, and the second clip section is disposed adjacent the second side of the standing seam and engages the upper and lower surfaces of the second metal panel; and wherein the first metal panel is in electrical communication with the second metal panel via the electrical bonding clip.

10. The panel assembly of claim 9, wherein the standing seam is a hollow seam rib or a folded standing seam.

11. The panel assembly of claim 9, wherein the electrical bonding clip is formed entirely of a conductive metal or metal alloy or the electrical bonding clip is formed of an integral construction.

12. The panel assembly of claim 9, wherein an inner edge of the second clip member is facing toward and positioned substantially parallel to an inner edge of the third clip member, and wherein the standing seam is disposed between the inner edges of the second and third clip members.

13. The panel assembly of claim 12, wherein the intermediate section extends below the standing seam and between the inner edges of the second and third clip members.

14. The panel assembly of claim 9, wherein the second clip member engages the upper surface of the first metal panel at a location that is spaced from the standing seam and the third clip member engages the upper surface of the second metal panel at a location that is spaced from the standing seam, and wherein the first clip member engages the underside of the panel section below the standing seam.

15. The panel assembly of claim 9, wherein the upper surface of the first part of the first clip member has at least one grounding projection extending toward a lower surface of the second clip member, wherein the upper surface of the second part of the first clip member has at least one grounding projection extending toward a lower surface of the third clip member, and wherein the lower surfaces of the second and third clip members lack grounding projections.

16. The panel assembly of claim 9, wherein the first living hinge is in contact with a first lateral edge of the first metal panel, wherein the second living hinge is in contact with a second lateral edge of the second metal panel, and wherein the first and second lateral edges are oriented orthogonally to the standing seam.

17. The panel assembly of claim 9, wherein the first clip section has a first grounding projection extending upward from the upper surface of the first part of the first clip member and a lower surface of the second clip member lacks a grounding projection, and wherein the second clip section has a second grounding projection extending upward from the upper surface of the second part of the first clip member and a lower surface of the third clip member lacks a grounding projection.

18. The panel assembly of claim 9, wherein the first part of the first clip member engages the lower surface of the first metal panel and the second clip member engages the upper surface of the first metal panel with the first living hinge in contact with the first metal panel, and wherein the second part of the first clip member engages the lower surface of the second metal panel and the third clip member engages the upper surface of the second metal panel with the second living hinge in contact with the second metal panel.

19. The panel assembly of claim 9, wherein the electrical bonding clip further comprises:

a first lateral edge extending in a lateral direction between the first living hinge and the second living hinge; and a second lateral edge extending in the lateral direction from the first end of the first part of the first clip member to the second end of the second part of the first clip member, wherein the second lateral edge bends downwardly away from a plane defined by the upper surface of the first clip member to facilitate installation of the electrical bonding clip onto the panel section, wherein the second lateral edge extends under the standing seam, and wherein the intermediate section of the electrical bonding clip is disposed below a portion of the standing seam.

20. The panel assembly of claim 9, wherein a lower surface of the second clip member is substantially smooth such that the second clip member is substantially flush with the upper surface of the first metal panel and a lower surface of the third clip member is substantially smooth such that the third clip member is substantially flush with the upper surface of the second metal panel, and wherein the first clip member is biased toward the second clip member and the third clip member.

21. The panel assembly of claim 9, wherein the second clip member is spaced from the first side of the standing seam and the third clip member is spaced from the second side of the standing seam such that an entirety of the standing seam on the exterior side of the panel section is exposed relative to the electrical bonding clip.

* * * * *